US006044243A

United States Patent [19]

Hara

[11] Patent Number: 6,044,243

[45] Date of Patent: Mar. 28, 2000

[54] IMAGE FORMING APPARATUS WITH A LAYERED RESIN INTERMEDIATE TRANSFER BELT

[75] Inventor: Yukio Hara, Ebina, Japan

[73] Assignee: Fuji Xerox Co., Ltd., Tokyo, Japan

[21] Appl. No.: 09/108,287

[22] Filed: Jul. 1, 1998

[30] Foreign Application Priority Data

Jul. 3, 1997 [JP] Japan ..... 9-178725

[51] Int. Cl.[7] ..... G03G 15/16

[52] U.S. Cl. ..... 399/302; 399/308; 430/126

[58] Field of Search ..... 399/302, 308; 430/126; 428/34.1

[56] References Cited

U.S. PATENT DOCUMENTS

| | | | |
|---|---|---|---|
| 5,370,961 | 12/1994 | Zaretsky et al. | 430/126 |
| 5,485,256 | 1/1996 | Randall et al. | 399/308 |
| 5,677,022 | 10/1997 | Zeman et al. | 428/34.1 |

FOREIGN PATENT DOCUMENTS

| | | |
|---|---|---|
| 62-206567 | 9/1987 | Japan . |
| 63-311263 | 12/1988 | Japan . |
| 5-200904 | 8/1993 | Japan . |
| 6-95521 | 4/1994 | Japan . |
| 6-140983 | 5/1994 | Japan . |
| 6-149079 | 5/1994 | Japan . |
| 6-149081 | 5/1994 | Japan . |
| 6-228335 | 8/1994 | Japan . |
| 8-50419 | 2/1996 | Japan . |

*Primary Examiner*—Susan S.Y. Lee
*Attorney, Agent, or Firm*—Oliff & Berridge, PLC

[57] ABSTRACT

An image forming apparatus provides a good quality image free from any destaticizing mechanism without toner scattering during transfer and a high quality transfer image invariably. The image forming apparatus also allows fair secondary transfer and prevention of image defects such as hollow character due to a small deformation of a belt material against the stress during driving. An electrostatic latent image formed on an image carrier 1 is rendered visible by a developing apparatus 4 to give a toner image. The toner image, which has primarily been transferred to an intermediate transfer belt 7, is then secondarily transferred to a recording medium P by the action of a bias roll 10. the intermediate transfer belt consists of at least two layers, a substrate having a Young's modulus of not less than 35,000 kg/cm$^2$ and a surface layer having a volume resistivity of from $10^{10}$ to $10^{13}$ Ωcm.

23 Claims, 8 Drawing Sheets

IMAGE FORMING APPARATUS WITH A LAYERED RESIN INTERMEDIATE TRANSFER BELT

FIELD OF THE INVENTION

The present invention relates to an image forming apparatus employing electrophotographic process such as electrophotographic copying machine, laser printer, facsimile and composite OA apparatus comprising these machines. More particularly, the present invention relates to an image forming apparatus employing a process which comprises primarily transferring a toner image formed on an image carrier to an intermediate transfer belt, and then transferring the toner image to a recording medium such as paper to obtain a reproduced image and to a process for the preparation of an intermediate transfer belt to be incorporated in the image forming apparatus.

BACKGROUND OF THE INVENTION

An image forming apparatus employing electrophotographic process forms electric charge uniformly on an image carrier made of a photoreceptor composed of an inorganic or organic photoconductive material, forms an electrostatic latent image when irradiated with laser obtained by modifying image signal or the like, and then develops the electrostatic latent image with a charged toner to give a visible toner image. The toner image thus obtained is then transferred to a recording medium such as paper directly or via an intermediate transfer medium to obtain a desired reproduced image.

An image forming apparatus employing a process which comprises primarily transferring a toner image formed on an image carrier to an intermediate transfer medium, and then secondarily transferring the toner image from the intermediate transfer medium to a recording medium is disclosed in, e.g., JP-A-62-206567 (The term "JP-A" as used herein means an "unexamined published Japanese patent application").

As the belt material to be incorporated in an image forming apparatus employing an intermediate transfer medium process there has been proposed an electrically-conductive endless belt comprising a thermoplastic resin such as polyvinylidene fluoride (PVDF) (JP-A-5-200904, JP-A-6-228335), polycarbonate (PC) (JP-A-6-95521), polyalkylene terephthalate (PAT) (JP-A-6-149081), blend of PAT and PC (JP-A-6-149083), blend of ethylene-tetrafluoroethylene copolymer (ETFE) and PC, blend of ETFE and PAT and blend of ETFE, PC and PAT (JP-A-6-149079) having an electrically conducting material such as carbon black dispersed therein.

The foregoing electrically-conductive material comprising a thermoplastic resin such as PVDF and PC exhibits mechanical properties as poor as not more than 24,000 kg/cm$^2$ as determined in terms of Young's modulus. Thus, the belt made of such an electrically-conductive material deforms greatly when stressed during driving. If this belt material is used as an intermediate transfer belt, a high quality transfer image cannot be stably obtained. Further, since the belt is liable to cracking at the edge thereof during driving, it exhibits a poor durability.

One of materials having excellent mechanical properties is a thermosetting polyimide resin. For example, JP-A-63-311263 proposes a seamless belt made of a polyimide resin comprising carbon black dispersed therein. This seamless belt is prepared by a process which comprises dispersing carbon black as an electrically conducting material in a solution of a polyamidic acid as a polyimide precursor, casting the dispersion over a metal drum, drying the material, peeling the film off the metal drum, orienting the film at a high temperature to form a polyimide film, cutting the polyimide film into a proper size, and then forming the film into an endless belt.

An ordinary process for the formation of the foregoing film comprises injecting a polymer solution having carbon black dispersed therein into a cylindrical mold, and then subjecting the polymer solution to centrifugal forming while being rotated at 1,000 to 2,000 rpm and heated to a temperature of from 110° C. to 150° C. so that it is formed into film. The film thus obtained is released half-hardened from the mold, and then put on an iron core where it is then allowed to undergo imidization reaction (ring closure reaction of polyamidic acid) at a temperature of from 300° C. to 450° C. so that it is thoroughly hardened.

In the foregoing rotary forming process such as centrifugal forming, however, if the solvent evaporates unevenly at the step of forming or full hardening, minute unevenness is formed on the surface of the film. If an intermediate transfer belt made of such a defective film is used to effect secondary transfer, the minute unevenness can cause the generation of minute maltransfer (white mark) and other troubles on the image transferred to the recording medium. On the other hand, the production of a smooth film takes much time to effect evaporation of solvent and hardening of polyamidic acid at the forming and hardening steps, adding to the production cost of belt.

The relationship between the surface resistivity and the volume resistivity of the polyimide resin film having carbon black dispersed therein produced by the foregoing forming process is shown in FIG. 11. As shown in FIG. 11, the polyimide resin film exhibits a volume resistivity of $10^{9.5}$ Ωcm when the surface resistivity thereof is $10^{13}$ Ω□.

If the surface resistivity of the intermediate transfer belt exceeds $10^{13}$ Ω/□, peeling discharge occurs at the post nip portion on the primary transfer portion where the image carrier and the intermediate transfer medium are separated from each other, causing white mark on the discharged portion. Accordingly, in order to avoid the occurrence of white mark with the foregoing intermediate transfer belt composed of a single resin film layer, it is necessary that the allowable volume resistivity fall below $10^{9.5}$ Ωcm. In this case, the intermediate transfer belt cannot exert an electrostatic force high enough to maintain electric charge for the unfixed toner image transferred to the transfer belt from the image carrier due to its own electric conductivity. Thus, due to mutual electrostatic repulsion force of toner particles or fringe electric field in the vicinity of image edge, the toner flies to the periphery of the image (blur), causing the formation of an image with much noise.

As shown in FIG. 12, which illustrates the relationship between the surface resistivity and the volume resistivity of a polyimide resin film having an electrically-conductive metal oxide dispersed therein, the resin film exhibits a volume resistivity of $10^{7.3}$ Ωcm when the surface resistivity thereof is $10^{13}$ Ω/□. Accordingly, if a metal oxide is used as an electrically conducting agent, there is no range of volume resistivity of resin film where the occurrence of the foregoing white mark and blue can be avoided at the same time.

Since a polyimide resin exhibits excellent mechanical properties, an intermediate transfer belt made of a polyimide resin deforms little when pressed against the image carrier by the bias roll. When a toner image is electrostatically transferred to such an intermediate transfer belt under the action of electric field, the load of pressure by the bias roll is concentrated at the primary transfer site. As a result, the toner image condenses to enhance the charge density, causing the occurrence of discharge inside the toner layer and hence the change of the toner polarity. This phenomenon can cause the occurrence of hollow character, i.e., image defect in which the hollow of line image is blank. This image defect can also occur at the secondary transfer site where the intermediate transfer belt is pressed against the backup roll with a paper provided interposed therebetween by the bias roll.

As a countermeasure against the foregoing image defect there may be proposed a belt material the surface layer of which is made of an elastic material. However, this countermeasure is disadvantageous in that if a rubber material such as silicone rubber is used as a surface material, the toner image cannot be transferred to the recording medium during the secondary transfer due to the adhesivity of the rubber material.

As a countermeasure against image defects such as hollow character, the inventors previously applied for patent an intermediate transfer belt made of a three-layer belt material consisting of a substrate having excellent mechanical properties, an interlayer composed of an elastic material such as fluororubber and a surface layer composed of a material having a small surface energy such as fluororesin, said belt material comprising an electrically conducting agent dispersed only in the substrate (Japanese Patent Application No. 8-236011). However, if the elastic material exhibits a volume resistivity of higher than $10^{14}$ Ωcm, the surface of the intermediate transfer belt is charged under an electric field developed by the primary transfer, requiring a destaticizing mechanism.

An electrically-conductive plastic belt comprising as a surface layer an electrically-conductive material obtained by incorporating an electrically-conductive filler in a fluororesin in such a proper proportion that the volume resistivity thereof reaches a range of from $10^7$ to $10^{10}$ Ωcm is proposed in JP-A-7-92825. However, the belt disclosed in the above citation is made of a substantially single-layer resin material and thus has no elasticity on the surface resin layer. Therefore, the belt can cause hollow character, i.e., image defect in which the hollow of line image is blank. Further, if the volume resistivity of the belt is lower than $10^{9.5}$ Ωcm, the electric charge given by a primary transferring apparatus such as bias roll and corotron is removed due to the electrical conductivity of the intermediate transfer medium during the primary transfer of the toner image from the image carrier to the intermediate transfer medium. As a result, blur occurs, causing the formation of an image with much noise as mentioned above. In particular, this phenomenon occurs remarkably in the periphery of an image having a great amount of toner per unit area such as multiple transfer image. This defect can be fatal to color image forming apparatus.

As mentioned above, the prior art intermediate transfer belt material has the following disadvantages. In other words, an electrically-conductive belt material made of a thermoplastic resin having poor mechanical properties deforms greatly when stressed during driving, making it impossible to stably obtain a high quality transfer image. Further, a single-layer belt material made of an electrically-conductive polyimide resin or fluororesin is disadvantageous in that it exhibits too low an allowable range of volume resistivity, causing the occurrence of blur. Moreover, an intermediate transfer belt comprising an elastic layer having no electrically conducting agent dispersed therein is disadvantageous in that it exhibits too high a volume resistivity, requiring a destaticizing mechanism.

On the other hand, a belt material made of a polyimide resin having excellent mechanical properties is disadvantageous in that it deforms little when pressed at the transfer zone under the pressure of the bias roll, causing the toner image to condense and hence generate image defects such as hollow character. Further, a belt material coated with a rubber material such as silicone rubber on the surface thereof is disadvantageous in that the toner image cannot be transferred to the recording medium during the secondary transfer due to the adhesivity of the rubber material.

SUMMARY OF THE INVENTION

It is therefore an object of the present invention to provide an image forming apparatus which can provide a good quality image free from any destaticizing mechanism without toner scattering during transfer and provide a high quality transfer image invariably.

It is another object of the present invention to provide an image forming apparatus which allows fair secondary transfer and prevention of the occurrence of image defects such as hollow character due to small deformation of the belt material against the stress during driving and a process for the preparation of an intermediate transfer belt for the image forming apparatus.

These and other objects of the present invention will become more apparent from the following detailed description and examples.

The inventors made extensive studies of solution to the foregoing problems. As a result, it was found that the foregoing main object of the present invention can be accomplished by the use of a belt material comprising a substrate made of a resin material having excellent mechanical properties and a surface layer having a specifically controlled volume resistivity as an intermediate transfer belt. It was also found that the latter object of the present invention can be accomplished by the use of a nonadhesive material having a small surface energy and a belt material which is elastic enough to avoid the concentration of stress thereon or the relative reduction of the Young's modulus of the surface layer.

The image forming apparatus of the present invention comprises an image carrier for forming an electrostatic latent image thereon corresponding to image information, a developing apparatus for developing the electrostatic latent image formed on said image carrier with a toner to render it visible as a toner image, an intermediate transfer belt onto which the toner image carried on said image carrier is primarily transferred, and a bias roll for secondarily transferring the unfixed toner image from said intermediate transfer belt to a recording medium, characterized in that said intermediate transfer belt has a layer structure comprising a plurality of belt materials composed of at least a substrate and a surface layer, said substrate is made of a resin material comprising an electrically-conducting material dispersed therein and exhibits a Young's modulus of not less than 35,000 kg/cm$^2$ and said surface layer exhibits a volume resistivity of from more than $10^{10}$ Ωcm to not more than $10^{13}$ Ωcm.

In the foregoing belt material, it is preferred that the surface layer be made of a material having a small surface energy comprising an electrically conducting agent dispersed therein. Alternatively, an elastic interlayer is preferably provided interposed between the substrate and the surface layer. Further, the material constituting the surface layer is preferably a rubber-modified fluororesin material or a fluororesin material having a Young's modulus of not more than 15,000 kg/cm$^2$.

The process for the preparation of an intermediate transfer belt for image forming apparatus according to the present invention comprises applying a coating solution containing a fluorinic high molecular weight material and carbon black to a substrate having a Young's modulus of not less than 35,000 kg/cm$^2$ made of a resin material comprising an electrically-conductive material dispersed therein, and then heating the coated material to a temperature of not lower than 250° C. to form an interlayer made of a fluororubber material comprising carbon black dispersed therein and a surface layer made of a fluororesin material comprising carbon black dispersed therein having a volume resistivity of from more than $10^{10}$ Ωcm to not more than $10^{13}$ Ωcm.

BRIEF DESCRIPTION OF THE DRAWINGS

By way of example and to make the description more clear, reference is made to the accompanying drawings in which.

DETAILED DESCRIPTION OF THE INVENTION

The present invention will be further described hereinafter.

The present invention is not specifically limited so far as it concerns an image forming apparatus of the intermediate transfer belt process. The present invention can be applied to, e.g., ordinary monochromatic image forming apparatus containing only a monochromatic toner in the developing apparatus, color image forming apparatus which sequentially repeats primary transfer of a toner image carried on an image carrier such as photoreceptor drum to an intermediate transfer belt, tandem type color image forming apparatus comprising a series combination of a plurality of image carriers provided with a developer for each color disposed on an intermediate transfer belt, etc.

Figure 1:
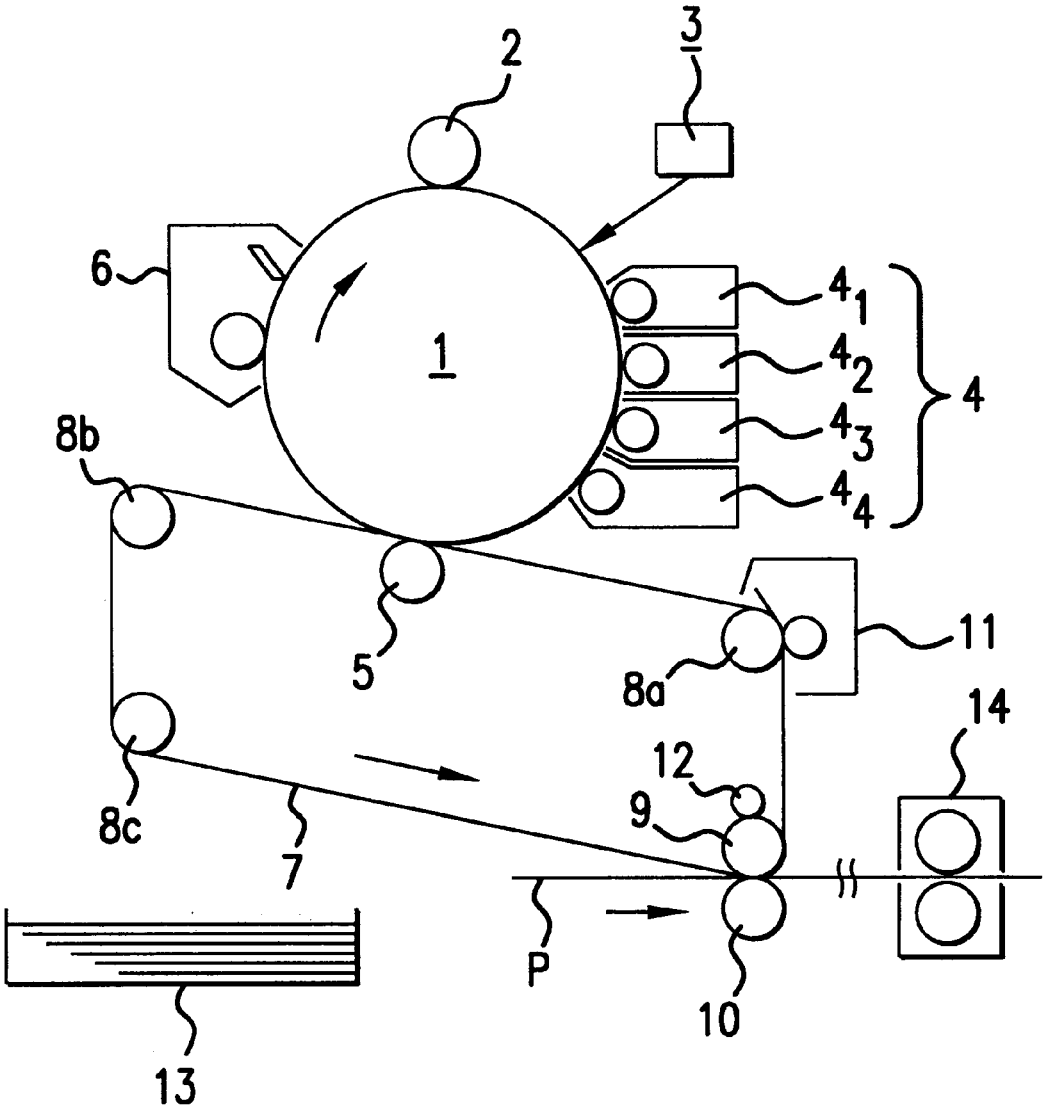
FIG. 1 is a schematic diagram illustrating an image forming apparatus of the intermediate transfer belt process comprising essential constituent membranes.

By way of example, a color image forming apparatus which repeats primary transfer is schematically shown in FIG. 1. In FIG. 1, around an image carrier 1 composed of a photoreceptor drum are disposed a charger 2, an image writing means 3, a developer 4, a primary transferring apparatus 5, a cleaning device 6, etc. in this order in the direction of rotation.

Stretched between tension rolls 8*a*, 8*b*, 8*c* and backup roll 9 is an intermediate transfer belt 7 which runs in the direction of arrow between the image carrier 1 and the primary transferring apparatus 5 while being in contact with the image carrier 1. A bias roll 10 and a belt cleaner 11 are disposed opposed to the backup roll 9 and the tension roll 8*a*, respectively, with the intermediate transfer belt 7 provided interposed therebetween.

The site at which the primary transferring apparatus 5 is pressed against the image carrier 1 with the intermediate transfer belt 7 provided interposed therebetween is the primary transfer site. A primary transfer voltage is applied across the gap between the image carrier 1 and the primary transferring apparatus 5. At the secondary transfer site where the bias roll 10 is pressed against the backup roll 9, an electrode member 12 from which a secondary transfer voltage is applied to the bias roll 10 is brought into contact with the backup roll 9 under pressure.

Referring to the operation of the color image forming apparatus shown in FIG. 1, the surface of the image carrier 1 which rotates in the direction of arrow is uniformly charged by means of the charger 2. A first color electrostatic latent image is then formed by means of an image writing means 3 which emits imagewise processds laser. The electrostatic latent image thus formed is then rendered visible by means of a developer 4 containing a toner corresponding to the color thereof to form a toner image. The toner image thus formed is then electrostatically and primarily transferred to the intermediate transfer belt 7 by means of the primary transferring apparatus 5 when it passes through the primary transfer site. Thereafter, second color, third color and fourth color toner images are primarily transferred to the intermediate transfer belt 7 carrying the first color toner image so that these toner images are sequentially superimposed on each other. Eventually, a full-color multiple toner image is obtained.

The foregoing developer 4 comprises a plurality of developers $\mathbf{4}_1$ to $\mathbf{4}_4$ each containing a toner corresponding to the respective electrostatic latent image. In other words, these developers contain a black (K) toner, a yellow (Y) toner, a magenta (M) toner and a cyan (C) toner, respectively.

The foregoing multiple toner image is then electrostatically transferred at a time to a recording medium (hereinafter typically referred to as "paper P") which has been supplied at a predetermined timing from a paper feed tray 13. The paper P to which a toner image has been transferred is passed to a fixing apparatus 14 where the toner image is then fixed. The paper P is then discharged out of the color forming apparatus.

The image carrier 1 which has passed through the primary transfer is then free of residual toner or electric charge by means of the cleaning device 9 or the like. The intermediate transfer belt 7 which has passed through the secondary transfer is then freed of residual toner by means of the belt cleaner 11 to prepare itself for subsequent image forming process.

If a multi-color image except full-color image is formed, toners corresponding to multi-color image are contained in two or three developers, respectively. If an electrostatic latent image is formed on the image carrier 1 by means of the image writing means 3 which performs imagewise processing to form a monochromatic electrostatic latent image, and only a toner corresponding to the color of the electrostatic latent image is contained in the developer 4, the image forming apparatus shown in FIG. 1 can be applied to monochromatic image forming apparatus. Further, the photoreceptor drum 1 may be replaced by a known belt photoreceptor.

As the foregoing primary transferring apparatus 5 there may be used a corona transferring apparatus such as corotron, transfer roll, transfer blade or the like. A voltage of 1 to 5 kV is applied to the primary transferring apparatus 5. By the action of an electric field developed between the image carrier 1 and the primary transferring apparatus 5, the toner image carried on the image carrier 1 is primarily transferred to the intermediate transfer belt 7.

The foregoing backup roll 9 forms a counter electrode for the bias roll 10. The backup roll 9 may have a single-layer structure or a multi-layer structure. If the backup roll 9 has a single-layer structure, it may be made of a silicone rubber, urethane rubber, EPDM (ethylenepropylene diene monomer) or the like comprising a fine electrically-conductive powder such as carbon black incorporated therein in a proper amount. If the backup roll 9 has a two-layer structure, it may be composed of a single-layer roll having a properly controlled volume resistivity as a sublayer and an electrically-conductive surface layer coated with, e.g., a fluororesin on the periphery thereof. Examples of the fluororesin employable herein include FEP (tetrafluoroethylene (TFE)-hexafluoropropylene (HFP) copolymer), and PFA (TFE-perfluoroalkyl vinyl ether copolymer).

The bias roll 10 which forms a transfer electrode is disposed apart from the intermediate transfer belt 7 while the toner image carried on the image carrier 1 is being primarily transferred to the intermediate transfer belt 7. When the toner image carried on the intermediate transfer belt 7 is secondarily transferred to the paper P, the bias roll 10 is brought into contact with the intermediate transfer belt 7 under pressure so that it is pressed against the backup roll 9.

The layer structure of the foregoing bias roll 10 is not specifically limited but may be either single or multiple. If the bias roll 10 has a single-layer structure, it may be made of a silicone rubber, urethane rubber, EPDM or the like comprising an electrically-conductive agent such as carbon black incorporated therein in a proper amount. If the bias roll 10 has a two-layer structure, it may be composed of a single-layer roll having a properly controlled volume resistivity as a sublayer and an electrically-conductive surface layer coated with, e.g., a fluororesin on the periphery thereof. Examples of the fluororesin employable herein include FEP, and PFA. Alternatively, the bias roll 10 may have a three-layer structure comprising a sublayer made of a foamed product and an interlayer made of a proper rubber material provided interposed between the sublayer and a surface layer. The bias roll 10 preferably exhibits a hardness of from 20° to 45° as determined by Aska C.

The electrode member 12 is not specifically limited so far as it is a member having a good electrical conductivity. For example, a metal roll made of aluminum, stainless steel, copper or the like, an electrically-conductive rubber roll, an electrically-conductive brush, a metal plate, an electrically-conductive resin plate or the like may be used. A transfer voltage of from −2 to −5 kV from the electrode member 12 is applied to the bias roll 10 via the backup roll 9. The polarity of the voltage applied to the electrode member 12 may be reversed to positive (+) depending on the charged polarity of the toner.

In the foregoing secondary transfer zone, the electrode member 12 is not necessarily an essential member. The foregoing transfer voltage may be applied to the electrically-conductive shaft of the backup roll 9 or to the bias roll 10.

Figure 2A:
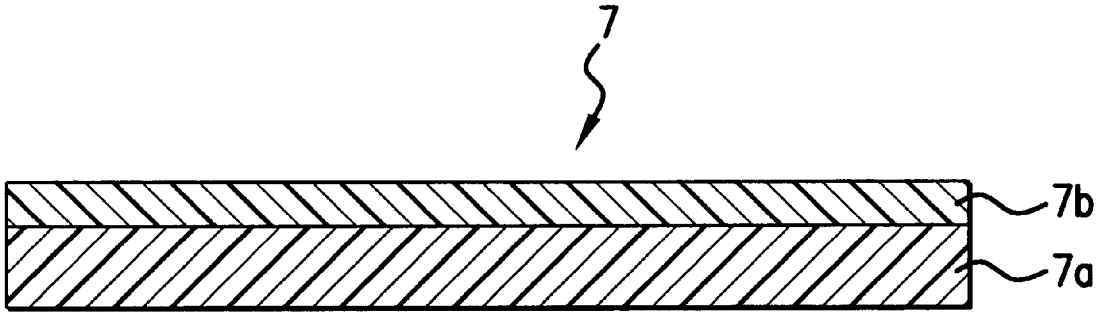
FIGS. 2A and 2B is a diagram illustrating the sectional structure of an intermediate transfer belt according to the present invention.
Figure 2B:
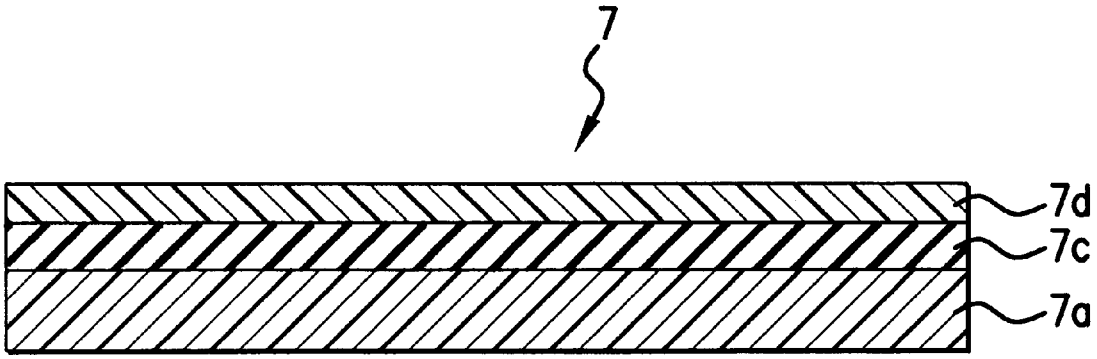

In the present invention, the foregoing intermediate transfer belt 7 is made of a multi-layer belt material comprising at least a substrate having a Young's modulus falling within a predetermined range and a surface layer having a volume resistivity falling within a predetermined range. Examples of the multi-layer structure include a two-layer structure consisting of a substrate 7*a* and a surface layer 7*b*, and a three-layer structure consisting of a substrate 7*a*, an interlayer 7*c* and a surface layer 7*d*, as shown in FIGS. 2A and 2B.

If the intermediate transfer belt 7 has a two-layer structure, it may be made of a substrate 7*a* having excellent mechanical properties comprising a resin material and an electrically conducting agent as constituents and a surface layer 7*b* having a volume resistivity falling within a predetermined range and preferably having a small surface energy comprising an elastic material and an electrically conducting agent as constituents. If the intermediate transfer belt 7 has a three-layer structure, it may be made of the foregoing substrate 7*a* having excellent mechanical properties, an interlayer 7*c* and the foregoing surface layer 7*d* having a volume resistivity falling within a predetermined range.

Examples of the resin material constituting the substrate include polyether sulfone, polyether ketone (including polyethylene ether ketone), and polyimide. Preferred among these resin materials is polyimide from the standpoint of availability. These resins are excellent in mechanical properties. A belt made of these resins deforms less during driving than the belt made of the prior art thermoplastic resin.

A polyether sulfone is a polymer containing a repeating unit having divalent aromatic hydrocarbon groups represented by —Ar— connected to each other via one or more ether groups (—O—) and sulfonyl groups (—$SO_2$—) or having a divalent dibenzofuran residual group with a sulfonyl group connected to one end thereof. Examples of Ar include benzene, biphenyl, naphthalene, terphenyl, and a combination of two benzenes connected to each other via alkylene group, sulfur atom or carbonyl group.

A polyether ketone is a polymer containing a repeating unit having divalent aromatic hydrocarbon groups represented by —Ar— connected to each other via one or more ether groups (—O—) and sulfonyl groups (—$SO_2$—). Examples of Ar include benzene, biphenyl, naphthalene, and a combination of two benzenes connected to each other via alkylene group, sulfur atom or carbonyl group.

A polyimide is a polymer synthesized by the polycondensation of tetracarboxylic dianhydrate with diamine or diisocyanate as monomer components.

Examples of the tetracarboxylic acid component constituting the polyimide include pyromellitic acid, naphthalene-1,4,5,8-tetracarboxylic acid, naphthalene-2,3,6,7-tetracarboxylic acid, 2,3,5,6-biphenyl tetracarboxylic acid, 2,2',3,3'-biphenyltetracarboxylic acid, 3,3',4,4'-biphenyltetracarboxylic acid, 3,3',4,4'-diphenylethertetracarboxylic acid, 3,3',4,4'-benzophenonetetracarboxylic acid, 3,3',4,4'-diphenylsulfonetetracarboxylic acid, azobenzene-3,3',4,4'-tetracarboxylic acid, bis(2,3-dicarboxyphenyl)methane, bis(3,4-dicarboxyphenyl)methane, β,β-bis(3,4-dicarboxyphenyl)propane, and β,β-bis(3,4-dicarboxyphenyl) hexafluoropropane.

Examples of the diamine component constituting the polyimide include m-phenylenediamine, p-phenylenediamine, 2,4-diaminotoluene, 2,6-diaminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminobiphenyl, benzidine, 3,3'-dimethylbenzidine, 3,3'-dimethoxybenzidine, 3,4'-diaminodiphenylether, 4,4'-diaminodiphenylether(oxy-p,p'-dianiline; ODA), 4,4'-diaminodiphenylsulfide, 3,3'-diaminobenzophenone, 4,4'-diaminodiphenylsulfone, 4,4'-diaminoazobenzene, 4,4'-diaminodiphenylmethane, and β,β-bis(4-aminophenyl)propane. Examples of the diisocyanate component constituting the polyimide include a compound obtained by substituting the amino group in the foregoing diamine component by an isocyanate group.

Examples of commercially available polyimides include pyromellitic acid-based polyimide containing ODA as a diamine component (Kapton HA, produced by Du Pont), 3,3',4,4'-biphenyltetracareboxylic acid-based polyimide (Upilex S, produced by Ube Industries, Ltd.), and 3,3',4,4'-benzophenonetetracarboxylic acid-based thermoplastic polyimide containing 3,3'-diaminobenzophenone as a diamine component (LARC-TPI, produced by Mitsui Toatsu Chemicals, Inc.).

Examples of the electrically conducting agent to be dispersed in the substrate include electrically-conductive carbon-based material such as carbon black and graphite, metal or alloy such as aluminum and copper alloy, electrically-conductive metal oxide such as tin oxide, zinc oxide, antimony oxide, indium oxide, potassium titanate, antimony oxide-tin oxide composite oxide (ATO) and indium oxide-tin oxide composite oxide (ITO), and fine powder of one or more electrolytes represented by the following general formula. The foregoing metal oxide may be coated with finely divided particles of insulating material such as barium sulfate, calcium carbonate and magnesium silicate. As the electrically conducting agent to be dispersed in the surface layers (7*a*, 7*d*) and interlayer (7*c*) there may be used one described above.

XnM wherein X represents an anionic component such as fluorine, chlorine, thiocyanic acid, perchloric acid, tetrafluoroboric acid, hexafluorophosphoric acid, trifluoromethanesulfonic acid, trifluoroacetic acid, octadecanesulfonic acid and dodecylbenzenesulfonic acid; M represents a cationic component such as alkaline metal (e.g., lithium, sodium, potassium), alkaline earth metal (e.g., magnesium, calcium, barium) and quaternary ammonium; and n represents an integer of 1 or 2 depending on the valence of M.

Preferred among these electrically conducting agents is carbon black from the standpoint of price and environmental stability. From the standpoint of dispersibility, a metal oxide having an average grain diameter of not more than 1 μm such as a tin oxide-based composite oxide having an average grain diameter of 0.1 μm (trade name: UF, produced by Mitsui Mining & Smelting Co., Ltd.), a zinc-based oxide having an average grain diameter of 0.3 μm (Pastran Type-II, produced by Mitsui Mining & Smelting Co., Ltd.), barium sulfate having an average grain diameter of 0.4 μm coated with a tin-based oxide (Pastran Type-IV, produced by Mitsui Mining & Smelting Co., Ltd.), ATO having an average grain diameter of 0.2 μm and ITO having an average grain diameter of 0.2 μm is preferably used as well.

The electrically-conductive metal oxide is preferably subjected to surface treatment with a silane-based coupling agent. Such a surface-treated metal oxide exhibits an improved compatibility with the resin constituting the substrate and thus can be uniformly dispersed in the substrate to inhibit the scattering of the resistivity of the substrate.

Examples of the silane-based coupling agent employable herein include vinyl trichlorosilane, vinyl triethoxysilane, vinyl tris(β-methoxyethoxy)silane, γ-chloropropyltrimethoxysilane, γ-mercaptopropyltrimethoxy silane, γ-glycidoxypropyltrimethoxysilane, γ-methacryloxy propyltrimethoxysilane, γ-aminopropyltriethoxysilane, N-(β-aminoethyl)-γ-aminopropyltrimethoxysilane, and N-(β-aminoethyl)-γ-aminopropylmethyldimethoxysilane.

The volume resistivity of the substrate preferably falls within the range of from $10^8$ to $10^{10}$ Ωcm. The volume resistivity of the substrate can be controlled to the above defined range by properly selecting the kind of the electrically conducting agent of adjusting the added amount of the electrically conducting agent.

It is known that the extension and shrinkage (displacement) of a belt material under load during driving is inversely proportional to the Young's modulus thereof. In other words, the relationship between the Young's modulus of a belt material and the displacement of the belt material under load during driving can be represented by the following equation (1):

$$\Delta l=\alpha\cdot P\cdot l/(t\cdot w\cdot E) \quad (1)$$

where

Δl: Displacement of belt (μm);

α: Coefficient;

P: Load (N);

l: Length of belt between two tension rolls (mm);

t: Thickness of belt (mm);

w: Width of belt;

E: Young's modulus of belt material ($N/mm^2$)

Thermoplastic resin materials which have heretofore been used, such as PC and PVDF, exhibit a Young's modulus of not more than 24,000 $kg/cm^2$ when they comprise carbon black dispersed therein. On the other hand, the substrate to be used herein exhibits a Young's modulus as high as not less than 35,000 kg/cm$^2$. Thus, the resulting belt extends or shrinks 30% or more less than the conventional belt material when the disturbance (load fluctuation) during driving is the same. Accordingly, the construction of a layer above the substrate such as surface layer or interlayer with an elastic material makes it possible to stably obtain a high quality transfer material.

In order to obtain a good quality transfer image by reducing the displacement of a belt due to disturbance during belt driving, the thickness of the substrate is preferably not less than 50 $\mu$m. If the thickness of the substrate is too great, the resulting belt material is liable to great deformation on the surface thereof, causing the deviation of the position of multiple toner images resulting in shear in color printing. Therefore, the thickness of the substrate is preferably from 50 to 150 $\mu$m, particularly from 70 to 100 $\mu$m.

In the present invention, if the belt material has a two-layer structure, the surface layer is preferably made of a material having a small surface energy, i.e., material comprising an electrically conducting agent dispersed therein having a contact angle of not less than 90° with respect to water droplet as represented by wettability by water. The term "wettability by water" as used herein is meant to indicate the angle of contact of a material constituting the surface layer as a specimen with respect to water droplet.

Figure 3:
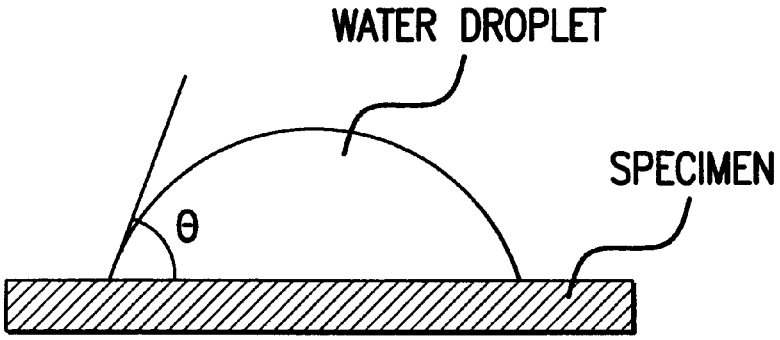
FIG. 3 is a sectional view of the surface of a specimen and water droplet illustrating the contact angle as a measure of surface energy.
Figure 4:
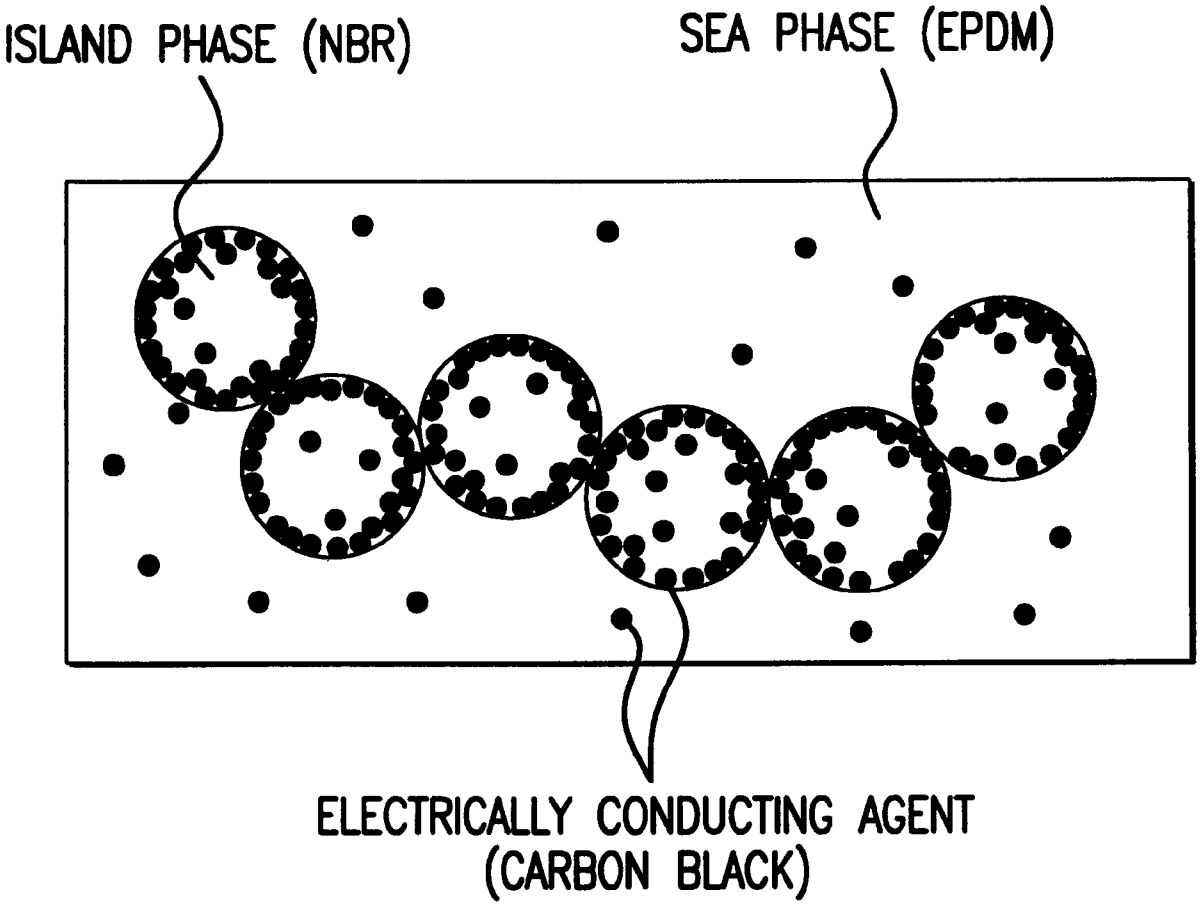
FIG. 4 is a sectional view of an interlayer of the present invention illustrating how an electrically-conductive agent is dispersed therein.

As shown in FIG. 3, when a water droplet is placed on the surface of a specimen, the surface tension $\gamma s$ of the specimen, the interfacial tension $\gamma i$ between the liquid and the specimen and the surface tension $\gamma l$ of the liquid are balanced to allow the water drop to form a certain shape. If the water droplet is small enough to neglect the weight thereof, the following Young's equation (2) can be established.

$$\gamma s=\gamma i+\gamma l \cos\theta \tag{2}$$

The term "material having a small surface energy" as used herein is meant to indicate a material having a contact angle $\theta$ of not less than 90° as determined above.

The surface energy will be described hereinafter from the standpoint of "wetting". From the macroscopical standpoint of view, wetting is a phenomenon in which the contact surface of solid with gas is spontaneously replaced by the contact surface of solid with liquid. This phenomenon is accompanied by the reduction of free energy of the system. From the microscopical standpoint of view, this phenomenon occurs when the molecular attraction (adhesion) between solid and liquid is greater than the intermolecular attraction or cohesive force of liquid.

It is known that the change of free energy starts from a system in which an already wet solid is in contact with a liquid and equals to the work required to separate the solid from the liquid but with an opposite sign. The foregoing work W is represented by the following equation (3):

$$W=\gamma sg+\gamma lg-\gamma sl \tag{3}$$

wherein $\gamma sg$, $\gamma lg$ and $\gamma sl$ represent solid-gas interfacial free energy, liquid-gas interfacial free energy and solid-liquid interfacial free energy having the same meaning as $\gamma s$, $\gamma l$ and $\gamma i$ in the foregoing equation (2), respectively. As can be seen in the equation (3), the change of free energy includes surface free energy of solid and solid-liquid interfacial free energy. Since the two free energies cannot be directly measured, the contact angle of solid with liquid droplet is utilized. In other words, the relationship between the foregoing $\gamma sg$, $\gamma lg$ and $\gamma sl$ and contact angle $\theta$ can satisfy the foregoing Young's equation as follows:

$$\mathrm{Cos}\theta=(\gamma sg-\gamma sl)/\gamma lg \tag{2'}$$

Thus, the free energy of the material constituting the surface layer is herein represented by the contact angle $\theta$ of the surface of the surface layer with water droplet.

Such a material is preferably a fluorinic high molecular weight material comprising an electrically conducting agent dispersed therein. Since a fluorinic high molecular weight material has a small surface energy, the surface of a belt made of such a material can hardly attract a toner, making it easy for the toner image on the belt material to be secondarily transferred to a paper. Further, hollow character due to the fixing of toner can hardly occur.

As the foregoing high molecular weight material there may be preferably used a fluororesin modified with various rubber materials. A rubber-modified fluororesin is nonadhesive and elastic and thus can prevent the occurrence of hollow character under the nip load, making it possible to obtain a good quality image.

Examples of the fluororesin employable herein include TFE, PFVD, ETFE, FEP, and PFA. The rubber material to be used for the modification of the fluororesin is not specifically limited. In practice, however, urethane rubber or fluororubber may be preferably used. If urethane rubber is used, the soft segment of the polyurethane provides the belt material with elasticity. As the electrically conducting agent there may be preferably used carbon black from the standpoint of price. As such a rubber-modified fluororesin having an electrically conducting agent dispersed therein there may be used one having a contact angle $\theta$ of not less than 90° with respect to water droplet as determined above.

Examples of commercially available rubber-modified fluororesin products include aqueous emulsion coating of urethane rubber and TFE resin (Emralon 345, JYL-601, produced by Nihon Acheson Inc.) having carbon black dispersed therein (Emralon 345ESD, JYL-601ESD, produced by Nihon Acheson Inc.), and aqueous emulsion coating of fluororubber and FEP (DAI-EL Latex GLS-213, produced by DAIKIN INDUSTRIES, LTD.) having carbon black dispersed therein (DAI-EL Latex NF-915, produced by DAIKIN INDUSTRIES, LTD.).

The surface layer of the belt material exhibits a volume resistivity falling within the range of from more than $10^{10}$ Ωcm to not more than $10^{13}$ Ωcm (hereinafter referred to as "$10^{10}$ Ωcm to $10^{13}$ Ωcm" for convenience' sake, though excluding $10^{10}$ Ωcm), preferably from $10^{10.3}$ to $10^{12}$ Ωcm. The volume resistivity of the surface layer can be easily controlled to the above defined range by properly selecting the kind of electrically conducting agent or adjusting the added amount of the electrically conducting agent as in the substrate.

When the volume resistivity of the surface layer is not more than $10^{10}$ Ωcm, particularly not more than $10^{9.5}$ Ωcm, the electric charge given by the primary transferring apparatus is removed due to the electrical conductivity of the intermediate transfer belt itself during the primary transfer of the toner image from the image carrier to the intermediate transfer belt. As a result, the intermediate transfer belt cannot exert an electrostatic force strong enough to maintain electric charge on the unfixed toner image which has been transferred from the image carrier to the intermediate transfer belt. The resulting electrostatic repulsion between toner particles or fringe electric field in the vicinity of the edge of image causes the toner to be scattered onto the periphery of the image (blur), resulting in the formation of an image with much noise. On the contrary, if the volume resistivity of the surface layer is not less than $10^{13}$ Ωcm, particularly not less than $10^{14}$ Ωcm, an electric field developed during the primary transfer causes the surface of the intermediate transfer belt to be electrically charged, producing the necessity of a destaticizing mechanism.

If the belt material has a two-layer structure, the thickness of the surface layer is preferably three times the average grain diameter of the toner to prevent the occurrence of hollow character. The term "average grain diameter of toner" as used herein is meant to indicate the volume-average grain diameter of the toner. In general, a toner having a volume-average grain diameter of from 3 to 13 μm may be used. By way of example, if a toner having a volume-average grain diameter of 7 μm is used, the thickness of the surface layer is preferably not less than 21 μm.

If the thickness of the surface layer is too great, the deformation of the belt differs greatly from one surface to the other at the tension roll sites (8*a* to 8*c*). Thus, the thickness of the surface layer is normally predetermined to not more than 80 μm. The thickness of the surface layer preferably falls within the range of from 30 to 65 μm.

The thin surface layer is normally formed by a process which comprises applying a coating solution of a fluorinic high molecular weight material having an electrically conducting agent dispersed therein to a substrate, and then heating the coated material. The substrate is preferably in the form of a seamless belt obtained by slitting a cylindrical film formed by centrifugal forming process into a strip having a proper width or slitting a sheet-like film formed by casting process into a strip having a proper length and width, and then bonding the both ends of the sheet with an adhesive.

The application of the coating solution can be carried out by brushing, dipping, spraying, roll coating or the like. The coating layer formed on the substrate can be heated to a temperature of from 100 to 180° C. for 4 to 35 minutes to harden the fluorinic high molecular weight material. The higher the heating temperature is, the shorter is the heating time. However, if the heating temperature is raised, the resulting surface layer tends to have a raised volume resistivity, producing the necessity of increasing the blended amount of the electrically conducting agent somewhat as compared with lower heating temperature.

The case where the intermediate transfer belt of the present invention is made of a three-layer belt material will be described hereinafter.

A three-layer belt material comprises an interlayer 7*c* and a surface layer 7*d* provided on a substrate 7*a* as mentioned above. The substrate 7*a* is similar to that of the two-layer belt material as mentioned above and is made of a resin material having a Young's modulus of not less than 35,000 kg/cm$^2$ comprising an electrically conducting agent dispersed therein. The interlayer 7*c* is made of an elastic material or adhesive comprising an electrically conducting agent dispersed or free of electrically conducting agent. The surface layer 7*d* is made of different constituent materials and has different thicknesses depending on the constituent material of the interlayer 7*c*. The surface layer 7*d* is preferably made of a material having a small surface energy comprising an electrically conducting agent dispersed therein. The surface layer 7*d* is identical to that of the two-layer belt material in that it exhibits a volume resistivity of from $10^{10}$ to $10^{13}$ Ωcm.

Preferred examples of combination of interlayer 7*c* and surface layer 7*d* include (i) combination of an interlayer made of an elastic material comprising an electrically conducting agent dispersed therein and a surface layer made of a fluorinic high molecular weight material comprising an electrically conducting agent dispersed therein, (ii) combination of an interlayer made of an elastic material comprising an electrically conducting agent dispersed therein or free of electrically conducting agent and a surface layer made of a rubber-modified fluororesin material comprising an electrically conducting agent dispersed therein, and (iii) combination of an interlayer made of an adhesive and a surface layer made of a material having a Young's modulus of not more than 15,000 kg/cm$^2$ and a small surface energy comprising an electrically conducting agent dispersed therein.

In the foregoing combination (i), the interlayer is made of an elastic material comprising an electrically conducting agent dispersed therein to avoid the concentration of stress developed by the pressure of the bias roll. This elastic material is not specifically limited. Any rubber material may be used. Specific examples of the rubber material employable herein include isoprene rubber, chloroprene rubber, butyl rubber, epichlorohydrin rubber, norbornene rubber, fluororubber, silicone rubber, urethane rubber, acrylic rubber, EPDM, SBR (styrene-butadiene rubber), NBR (acrylonitrile-butadiene rubber), and styrene-butadiene-styrene rubber. These rubber materials may be used singly or in combination. Since the interlayer is normally formed by coating method, it is preferably made of a heat resistant elastic material such as fluororubber and silicone rubber.

Examples of the fluororubber include TFE rubber, PVDF, polychlorotrifluoroethylene, PFA, ETFE, FEP, VDF-trifluoroethylene copolymer, VDF-HFP copolymer, and PFA-HFP copolymer. As the silicone rubber there may be preferably used a one-pack type RTV (room temperature vulcanizing) type silicone rubber having a hardness of from 20° to 60° (JIS A).

The thickness of the interlayer is preferably from three times the average grain diameter of the toner to 80 μm for the same reason as in the surface layer 7*b* of the two-layer interlayer.

The surface layer is made of a fluorinic high molecular weight material comprising an electrically conducting agent dispersed therein as mentioned above. The thickness of the surface layer is preferably not more than 30 μm.

In particular, if the interlayer is made of a fluororubber, the use of a fluororesin-modified fluororubber comprising an electrically conducting agent dispersed therein makes it possible to form the interlayer and the surface layer at one heating step. The formation of these layers can be accomplished by a process which comprises applying an aqueous emulsion coating of fluororesin-modified fluororubber having carbon black dispersed therein (e.g., DAI-EL Latex NF-915) to a substrate, and then heating the coated material to a temperature of not lower than 250° C., preferably from 250° C. to 300° C., for 10 to 30 minutes.

The formation of a resin layer as a surface layer and a rubber material layer inside the surface layer in the coating layer made of fluorinic high molecular weight material is attributed to the small surface energy of fluororesin that causes the phase separation of the resin material and the rubber material. This tendency becomes more remarkable as the heating temperature rises. On the other hand, in order to inhibit the deterioration of the substrate and the interlayer as much as possible, the coated material is preferably heated at a temperature as low as possible. Thus, the formation of the surface layer and the interlayer is effected at the above defined temperature range. As the fluororesin there may be preferably used one having a melting point of not more than 300° C. such as FEP (mp: 275° C.) and ETFE (mp: 270° C.).

Since the fluororesin layer formed by the foregoing process exhibits a high hardness, the thickness of the surface layer is preferably not more than 5 μm so that the elasticity of the interlayer is not impaired. The lower limit of the thickness of the surface layer is such that the adhesion of the surface of the belt due to the elastic material constituting the interlayer can be inhibited and is normally about 1 μm. The foregoing process makes it possible to form a surface layer and an interlayer having a thickness falling within the above defined range at the same time.

In the foregoing combination (ii), the interlayer is made of an elastic material comprising an electrically conducting agent dispersed therein or free of electrically conducting agent. As such an elastic material there may be used a rubber material as exemplified with reference to the combination (i). However, a rubber material having a high polarity such as epichlorohydrin rubber, NBR and chlorinated polyethylene, if used, doesn't necessarily need to comprise an electrically conducting agent dispersed therein. In other words, the lower limit of the volume resistivity of the interlayer preferably falls within the range of from $10^9$ to $10^{13}$ Ωcm. If the volume resistivity of the interlayer deviates from this range, the volume resistivity of the intermediate transfer belt deviates from the proper range, disadvantageously causing the occurrence of blue or producing the necessity of a destaticizing mechanism for the same reason as in the surface layer 7*b* of the two-layer structure. The volume resistivity of the interlayer can be applied to the foregoing combination (i).

The surface layer is made of the foregoing rubber-modified fluororesin material comprising an electrically conducting agent dispersed therein. The surface layer 7*d* can be formed in the same manner as the foregoing surface layer 7*b*.

The thickness of the interlayer is preferably from three times the average grain diameter of the toner to 80 μm for the same reason as mentioned above. The thickness of the surface layer preferably falls within the range of from 5 to 35 μm. If the surface layer has a thickness of less than 5 μm, it can wear to cause the interlayer to be exposed after prolonged repetition of contact of the intermediate transfer belt with the bias roll with the image carrier and paper interposed therebetween and running of the intermediate transfer belt. Further, the thickness of the coating layer formed by coating can vary widely. On the contrary, if the thickness of the surface layer exceeds 35 μm, sag occurs during the formation of coating layer by coating method, making it difficult to stably form a smooth and uniform coating layer. Anyway, coating method can be hardly employed as a method for forming the surface layer.

As the rubber material constituting the foregoing interlayer there may be used one exemplified above. Preferred among these rubber materials is an incompatible blending rubber material.

As an index of the intermolecular force of a substance there may be used a solubility parameter δ (SP value) represented by the following equation (4). It is known that the greater SP value is, the higher is the polarity of the substance. It is also known that the smaller the difference in SP value between substance is, the higher is the compatibility with each other, or vice versa.

$$\delta^2=\delta^2_d+\delta^2_p{}'+\delta^2_h \quad (4)$$

wherein $\delta^2_d$, $\delta^2_p{}'$, and $\delta^2_h$ represent dispersion force, polar effect, and SP value based on hydrogen bond, respectively.

Supposing that the cohesive energy is E (cal=4,1868 J) and the molar value is Vm ($cm^3$), the foregoing SP value (δ) can be represented by the following equation (5):

$$\delta=(E/Vm)^{1/2}[J^{1/2}/cm^{2/3}] \quad (5)$$

Examples of the rubber material having a high SP value include urethane rubber (SP value: 10), acrylic rubber (9.5), chlorinated polyisoprene rubber (9.35), NBR (9.31), and chloroprene rubber (8.71). Examples of the rubber material having a low SP value include silicone rubber (SP value: 7.45), butyl rubber (7.85), EPDM (8.0), and hydrogenated polybutadiene rubber (8.08). Among these rubber materials, even the same series rubber materials but having different proportions of side chain substituents for polymer main chain or copolymerizable components have different SP values. Taking NBR for an example, NBR comprising acrylonitrile, which contains a cyano group having a great polarity, in a proportion of 18%, 20%, 25%, 30% and 39% by weight exhibits an SP value of 8.71, 9.25, 9.31, 9.68 and 10.39, respectively. In general, a material having a high SP value exhibits a good affinity for electrically conducting agent while one having a low SP value exhibits a poor affinity for electrically conducting agent.

As the blending material constituting the interlayer, a combination of at least two rubber materials having a SP value difference of not less than 1.0, preferably not less than 1.3, is particularly desirable. A preferred example of the combination of blending rubber materials is a combination of NBR and EPDM. The proportion of NBR and EPDM (by weight) is preferably from 2:8 to 7:3.

When an electrically conducting agent such as carbon black is dispersed in an incompatible blending rubber material, it condenses densely at the interface of "sea phase" having a high blending proportion of rubber material with "island phase" having a low blending proportion of rubber material to form an electrically-conductive rubber phase having an electrically conducting agent unevenly dispersed therein. In the electrically-conductive rubber phase, the portion in which the electrically conducting agent condenses densely contributes to electrical conduction, making it possible to form a stable electrically conducting path. Further, this arrangement makes it possible to reduce the blended amount of the electrically conducting agent and hence inhibit the rise in the hardness of the rubber phase.

Carbon black to be used as an electrically conducting agent tends to form a chainlike bond in a rubber composition in which it is incorporated. The rubber composition exhibits different resistivities depending on the length of such a chainlike bond. If this chainlike bond is long, the electrical conductivity of the interlayer is improved and the resistivity of the interlayer is lowered. On the contrary, if this chainlike bond is short, the electrical conductivity of the interlayer is lowered and the resistivity of the interlayer is raised. In other words, if carbon black which forms a long chainlike bond is incorporated in a rubber composition, the resistivity of the intermediate transfer belt changes greatly as compared with the case where carbon black which form a short chainlike bond is incorporated in the rubber composition in the same amount. It is thus preferred that carbon blacks having different surface properties and other properties be used in combination.

The length of the foregoing chainlike bond depends on the diameter or surface activity of individual carbon black particles. One of indexes of the length of chainlike bond is DBP (dibutyl phthalate) oil absorption defined in ASTM D2414-6TT. This DBP oil absorption is represented by how much DBP (ml) can be absorbed by 100 g of carbon black.

It is said that carbon black having a higher DBP absorption, i.e., higher oil absorption forms a longer chainlike bond.

If the resistivity of the interlayer is adjusted merely by incorporating only carbon black having a high DBP oil absorption in a blending rubber at the step of forming the interlayer, the resistivity of the interlayer can change with a slight change of the blended amount of carbon black. Thus, the interlayer cannot be provided with a predetermined resistivity unless the blended amount and dispersion condition of carbon black are strictly defined.

On the other hand, if the resistivity of the interlayer is adjusted merely by incorporating only carbon black having a low DBP oil absorption in a blending rubber, carbon black can be dispersed in the rubber composition more uniformly than the case where only carbon black having a high DBP oil absorption is incorporated, giving less resistivity change with the change of the blended amount of carbon black. However, in order to provide the interlayer with a predetermined resistivity, it is necessary that carbon black be incorporated greater than the case where carbon black having a high DBP oil absorption is incorporated. As a result, the mixing proportion of carbon black in the rubber composition is raised to give a rubber composition having a raised viscosity which can hardly be processed when kneaded by means of a Banbury mixer, kneader or the like.

Accordingly, two or more carbon blacks having different DBP oil absorptions, i.e., one having a high DBP oil absorption and another having a low DBP oil absorption may be preferably used in combination.

As the foregoing carbon blacks to be incorporated in the blending rubber material there maybe any carbon blacks having different DBP oil absorptions. However, if the different in DBP oil absorption between these carbon blacks is too small, it can produce results similar to that of the case where only one kind of carbon black is incorporated in the rubber composition. Accordingly, as carbon blacks there may be preferably used those differing in DBP oil absorption to some extent. The carbon black having a high DBP oil absorption preferably exhibits an oil absorption of not less than 250 ml/100 g, and the carbon black having a low DBP oil absorption preferably exhibits an oil absorption of not more than 100 ml/100 g.

Specific examples of the carbon black having a high oil absorption include acetylene black such as HS-500 (oil absorption: 447 ml/100 g; produced by Asahi Carbon Co., Ltd.), kitchen black having an oil absorption of 360 ml/100 g (produced by Lion Akzo Co., Ltd.), particulate acetylene black having an oil absorption of 288 ml/100 g (produced by DENKI KAGAKU KOGYO K. K.) and Balkan XC-72 (oil absorption: 265 ml/100 g; produced by Cabot Specialty Chemicals Inc.). Examples of the carbon black having a low DBP oil absorption include thermal black such as Asahi Thermal FT (oil absorption: 28 ml/100 g; produced by Asahi Carbon Co., Ltd.) and Asahi Thermal MT (oil absorption: 35 ml/100 g; produced by Asahi Carbon Co., Ltd.).

If the resistivity of the interlayer is adjusted by the use of a mixture of an acetylene black having a high DBP oil absorption and a thermal black having a low oil absorption, their mixing proportion by weight is from 1:1 to 1:10, preferably from 1:2 to 1:5. If the ratio of thermal black to acetylene black falls below 1, it causes the resistivity of the interlayer to be widely scattered. Further, the change of the added amount of the mixture causes the resistivity of the intermediate transfer belt to vary widely. On the contrary, if the ratio of thermal black to acetylene black exceeds 10, the resulting rise in the viscosity of the rubber composition during kneading makes it difficult to form an interlayer as mentioned above. Further, the resulting interlayer exhibits a raised hardness.

Thus, by adjusting the mixing proportion of carbon blacks having different DBP oil absorptions and the proportion of these carbon blacks based on the rubber material, rapid change in the resistivity of the intermediate transfer belt can be inhibited. At the same time, the addition of a small amount of such a mixture of carbon blacks makes it possible to form an interlayer having a small variation of resistivity as compared with the case where a carbon black having a low oil absorption is singly used.

Accordingly, the use of two or more incompatible blending rubbers and two or more carbon blacks having different DBP oil absorptions as constituent materials of the interlayer causes carbon black to condense densely on the interface of rubber phase to form a stable electrically conducting path all over the interlayer, making it possible to drastically reduce the variation of the resistivity of the interlayer and the intermediate transfer belt.

In the combination (iii), the interlayer is made of an adhesive. The adhesive is not specifically limited. In practice, however, the adhesive is preferably mainly composed of a material which is strong and flexible enough to relax the difference in deformation of the belt from one surface to the other at the tension roll sites (8*a* to 8*c*, 9). Specific examples of such an adhesive include one-pack type or two-pack type silicone-based elastic adhesive, urethane-based elastic adhesive, sheet-like hot melt type silicone adhesive, and silane-modified polyimide adhesive. The silicone adhesive and urethane adhesive may be modified with various components or functional groups. These adhesives may be used singly or in combination with an adhesive having a high strength such as epoxy adhesive.

Examples of commercially available adhesive products include one-pack type elastic adhesives such as special modified silicone (SILEX 100, produced by Konishi Co., Ltd.) and special modified silyl group-containing polymer (Super X No. 8008, produced by CEMEDINE CO., LTD.), two-pack type elastic adhesives such as adhesive mixed with an epoxy containing a special modified silicone as a main component (MOS7, MOS1010, produced by Konish Co., Ltd.), and sheet-like hot melt type adhesives such as adhesive mixed with an epoxy resin containing a special modified silicone as a main component (Staystick 473, produced by Techno-alpha Co., Ltd.) and polyurethane adhesive (Thermolite 6501, produced by Daicelhues Ltd.).

The thickness of the adhesive constituting the interlayer is preferably from 5 to 25 $\mu$m. If the thickness of the adhesive falls below 5 $\mu$m, the adhesive layer can be hardly provided uniformly interposed between the substrate and the surface layer. On the contrary, if the thickness of the adhesive exceeds 25 $\mu$m, the resistivity of the intermediate transfer belt is higher than required because an adhesive is normally insulating.

The surface layer is made of a material having a Young's modulus of not more than 15,000 kg/cm$^2$ and a small surface energy comprising an electrically conducting agent dispersed therein. Examples of such a material include ETFE which exhibits a Young's modulus of about 11,900 kg/cm$^2$ at a volume resistivity of from $10^{10}$ to $10^{15}$ $\Omega$cm, and PFA exhibits a Young's modulus of about 6,300 kg/cm$^2$ at a volume resistivity of from $10^{10}$ to $10^{13}$ $\Omega$cm. These materials exhibit a relatively small Young's modulus and a small surface energy and thus can avoid the concentration of stress that causes the occurrence of hollow character.

The thickness of the surface layer is preferably from 50 to 150 $\mu$m for the same reason as the surface layer 7*b* of the two-layer structure.

In order to bond a surface layer having a small surface energy to a substrate, the surface layer is preferably subjected to corona discharge treatment that causes the surface layer to be oxidized and have carbonyl group introduced thereinto so that one surface thereof is activated. Alternatively, the surface layer is preferably subjected to surface cleaning treatment with an alkaline solution or the like, e.g., dipping in an aqueous solution of a base such as sodium hydroxide for 15 minutes to 1 hour so that the other surface thereof exhibits an enhanced adhesivity.

In the case of the combination (iii), an adhesive layer (interlayer) doesn't necessarily need to be provided interposed between the surface layer and the substrate. For example, an unhardened surface layer material sheet may be heat-hardened while being pressed against the substrate to bond the two layers directly to each other.

The total thickness of the intermediate transfer belt is basically the sum of the thickness of the various layers and is normally from 65 to 250 $\mu$m, particularly from 100 to 200 $\mu$m. If the total thickness of the intermediate transfer belt falls below 65 $\mu$m, hollow character can easily occur. On the contrary, if the total thickness of the intermediate transfer belt exceeds 250 $\mu$m, the difference in deformation of the belt from one surface to the other is raised, causing shear in transfer.

The volume resistivity of the intermediate transfer belt preferably falls within the range of from $10^{9.5}$ to $10^{14}$ Ωcm. If the volume resistivity of the intermediate transfer belt deviates from the above defined range, required electric charge can be hardly maintained for the same reason, causing the occurrence of blue. Further, the primary transfer voltage causes the belt to be electrostatically charged, producing the necessity of a destaticizing mechanism.

As mentioned above, the intermediate transfer belt according to the present invention comprises a substrate made of a resin material having a Young's modulus of not less than 35,000 kg/cm$^2$ comprising an electrically conducting agent dispersed therein and a surface layer having a volume resistivity of from $10^{10}$ to $10^{13}$ Ωcm. Accordingly, the intermediate transfer belt according to the present invention deforms little when stressed during driving. Thus, a high quality transfer image can be invariably obtained. Further, no blur occurs during transfer. Moreover, no destaticizing mechanism is required.

The present invention will be further described in the following examples, but the present invention should not be construed as being limited thereto. (Image forming apparatus)

Figure 5:
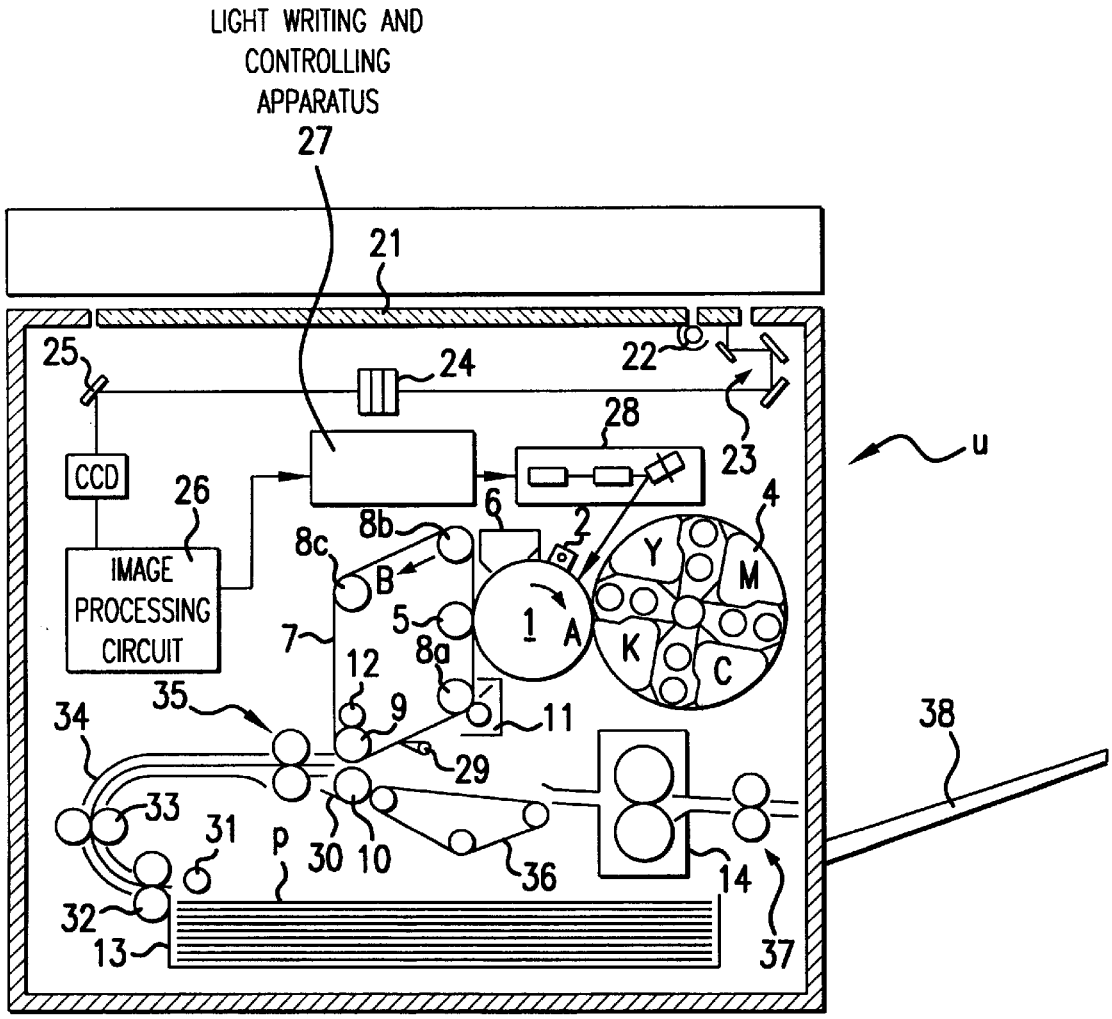
FIG. 5 is a general view illustrating an image forming apparatus as an embodiment of the present invention.

FIG. 5 is a general view illustrating as an embodiment of the image forming apparatus according to the present invention a digital color copying machine provided with an intermediate transfer belt.

In FIG. 5, light is emitted by an original illuminating lamp 22 which moves along the lower surface of an original (not shown) placed on a platen 21. The light reflected by the original is then converged through a moving mirror unit 23, a lens 24 and a fixed mirror 25 onto CCD of an image reading portion. In CCD, the original image is processed through a number of photoelectric elements and three color filters, i.e., red (R), green (G) and blue (B) filters so that it is converted into electrical signals corresponding to the respective colors. These electrical signals are then inputted to an image processing circuit 26 which comprises image memories which each convert the original image readout signal into digital signal and store it.

A light writing and controlling apparatus 27 reads out image information from the image processing circuit 26 at a predetermined timing, and then inputs it to a light beam writing apparatus 28. The light beam writing apparatus 28 then writes electrostatic latent images corresponding to the respective colors on an image carrier 1 which rotates in the direction of arrow A. These elements 21 to 28 constitute an image writing means 3.

Disposed around the image carrier 1 are a charger 2 which is uniformly charged on the surface thereof, a developing apparatus 4 which develops the electrostatic latent images written on the image carrier 1 into the respective color toner images, a primary transfer roll 5 which transfers the respective color toner images onto an intermediate transfer belt 7, and cleaning device 6 comprising a cleaning blade and a destaticizer. The developing apparatus 4 comprises developing units containing K, Y, M and C toners, respectively, with which the electrostatic latent images are developed to give visible images.

The intermediate transfer belt 7 is stretched between tension rolls 8*a*, 8*b*, 8*c* and a backup roll 9 and moves in the tangential direction while being in contact with the surface of the image carrier. Disposed opposed to the backup roll 9 and the tension roll 8*a* on the surface of the transfer belt 7 carrying the unfixed toner image are a bias roll 10 and a belt cleaner 11. An electrode roll 12 to which a secondary transfer voltage of the same polarity as that of the toner is applied comes in contact with the backup roll 9 under pressure. Disposed between the bias roll 10 and the belt cleaner 11 is a peeling nail 29 for peeling a paper P carrying the secondarily transferred toner image off the transfer belt 7. A cleaning blade 30 formed of polyurethane is always in contact with the surface of the bias roll 10 so that foreign matters such as toner particles and paper dust attached during transfer step can be removed.

Provided at the bottom of the image forming apparatus U is a removable paper feed tray 13 over which a pickup roller 31 is disposed. Sequentially disposed downstream from the pickup roller 31 are a pair of feed rolls 32 for preventing the paper P from being carried in layers, a pair of paper carrying rolls 33, a guide member 34 for guiding the paper P, and a pair of resist rolls 35.

Sequentially disposed downstream from the secondary transfer zone are a conveying belt 36 for carrying the paper P carrying the secondarily transferred toner image, a fixing apparatus 14 for fixing the unfixed toner image on the paper P, a pair of discharge rolls 37 for discharging the paper P on which a fixed image has been formed out of the image forming apparatus, and a paper output tray 38 on which the paper P thus outputted rests.

(Operation of image forming apparatus)

The image carrier 1 which rotates in the direction of arrow A is electrostatically charged to a predetermined potential on the surface thereof by means of a charger 2. An electrostatic latent image is then written on the image carrier 1 by means of the light beam writing apparatus 28. Referring to the formation of toner image, a first color toner image is formed firstly. Every time the image carrier 1 rotates one time, another color toner image is formed until a fourth color toner image is formed. In the present embodiment, K, Y, M and C color toner images are sequentially formed. After the toner image has been transferred to the intermediate transfer belt 7, the surface of the image carrier 1 is freed of residual toner and electric charge by means of the cleaning device 6.

In the light writing and controlling apparatus 27, digital signal which has been obtained by imagewise processing the first color, i.e., K color is read out and then inputted to the light beam writing apparatus 28. The writing apparatus 28 writes an electrostatic latent image corresponding to K color on the surface of the image carrier 1. The electrostatic latent image corresponding to K color is processed by a developing unit K in the developing apparatus 4 so that it is developed into a visible K color toner image which then moves to the primary transfer zone. In the primary transfer zone, an electric field of the polarity opposite that of the charged toner image from a primary transfer roll 5 disposed on the other surface of the intermediate transfer belt 7 is applied to the toner image on the image carrier 1. Thus, the K color toner image which has reached the primary transfer zone is electrostatically attracted by the transfer belt 7 which is moving in the direction of arrow B so that the toner image is primarily transferred.

The intermediate transfer belt 7 moves carrying the K color toner image at the same period as the image carrier 1. When the transfer of the first color (K) toner image is terminated, the writing of an electrostatic latent image corresponding to light image obtained by color separation by a blue (B) filter is initiated by the output from the light writing and controlling apparatus 27 until the position on the transfer belt 7 at which the transfer of the K color toner image begins reaches the primary transfer zone again. When the foregoing transfer initiating position on the transfer belt 7 carrying the K color toner image reaches the primary transfer zone, the second color 'Y) toner image is then transferred to the transfer belt 7 by means of the primary transfer roll 5. Subsequently, electrostatic latent images corresponding to light image obtained by color separation by green (G) and red (R) filters are rendered visible by means of developing units M and C. The M and C color toner images are then transferred in the same manner as the Y color toner image.

Thus, a multiple toner image obtained by superimposing various color toners one each other is formed on the intermediate transfer belt 7. The bias roll 10, the peeling nail 29 and the belt cleaner 11, which are disposed on the surface side of the transfer belt 7, are kept apart from the transfer belt 7 until the various toner images are primarily transferred to the transfer belt 7.

On the other hand, sheets of the paper P which have been received in the paper feed tray 13 are picked up one by one at a predetermined timing by means of the pickup roller 31. The paper P thus picked up is fed through a pair of feed roll 32 and a pair of paper carrying roll 33 and then stops at a pair of resist rolls 35. The paper P is then conveyed to the secondary transfer zone from the resist roll 35 with a period synchronized with the movement of the multiple toner image of various colors (K, Y, M, C) carried on the intermediate transfer belt 7 to the secondary transfer zone.

In the secondary transfer zone, the bias roll 10 kept in contact with the backup roll 9 under pressure with the intermediate transfer belt 7 interposed therebetween. The paper P which has been conveyed then passes though the secondary transfer zone with the aid of the rolls 9 and 10, which rotate pressed against each other with the transfer belt 7 moving interposed therebetween. During this process, a transfer voltage of the same polarity as the charged toner image is applied to the electrode roll 12 so that the multiple toner image attracted by and carried on the transfer belt 7 is secondarily transferred to the paper P.

The present embodiment has been described with reference to the transfer of full-color image. In the case of formation of a monochromatic image, a toner image of, e.g., K color which has been primarily transferred to the intermediate transfer belt 7 is immediately transferred to the paper P when it reaches the secondary transfer zone. In the case of formation of an image of a plurality of colors, a multiple-color toner image obtained by superimposing various desired color hues may be transferred to the paper P when it reaches the secondary transfer zone.

The paper P to which the toner image has been transferred with a desired color hue is peeled off by the action of the peeling nail 29 is then placed on the conveying belt 36 which then carry it to the fixing apparatus 14. In the fixing apparatus 14, the unfixed toner image on the paper P is then fixed to give a permanent image. The paper P is then discharged to the paper output tray 38 by a pair of discharge rolls 37. Once the secondary transfer has been terminated, the intermediate transfer belt 7 is cleaned by means of the belt cleaner 11 provided downstream from the secondary transfer zone so that it is prepared for subsequent transfer.

(Preparation of intermediate transfer belt)

EXAMPLE 1

Carbon black was added to a polyimide varnish (heat-resistant polyimide varnish comprising Upilex S as a resin componet dissolved in N-methylpyrrolidone as a solvent; U Varnish-S, produced by Ube Industries, Ltd.) in an amount of 18 parts by weight based on 100 parts by weight of the resin component. The mixture was then thoroughly stirred in a mixer. The film-forming stock solution thus obtained was injected into a cylindrical stainless steel mold having a diameter of 168 mm and a height of 500 mm, and then subjected to centrifugal forming while being dried in a 120° C. hot air for 120 minutes.

Subsequently, a cylindrical film which had been released half-hardened from the mold was put on an iron core, and then heated from 120° C. to 350° C. in 30 minutes so that the solvent was evaporated. The film was then heated to a temperature of 450° C. for 20 minutes so that polyamidic acid was subjected to dehydro-condensation to undergo full hardening. The polyimide film having a thickness of 80 $\mu$m having carbon black dispersed therein was then slit into a 320 mm wide strip to form a seamless belt substrate 7*a*.

Subsequently, an aqueous emulsion coating containing an urethane rubber having carbon black dispersed therein in an amount of 6% by weight as calculated in terms of solid content and a TFE resin (Emralon JYL-601ESD) was applied to the belt substrate 7*a* by spray coating method, and then heated to a temperature of 150° C. for 10 minutes to form a surface layer 8*b* having a thickness of 50 $\mu$m (about 7 times the volume-average grain diameter of the toner). This surface layer 7*b* comprised an urethane-modified TFE resin having carbon black dispersed therein. The surface layer 7*b* exhibited a volume resistivity of $10^{11.2}\Omega$cm and a contact angle $\theta$ of 90° with respect to water droplet. An intermediate transfer belt 7 formed of the foregoing belt material exhibited a surface resistivity of $10^{12.1}\Omega/\square$ and a volume resistivity of $10^{11.0}\Omega$cm.

The measurement of volume resistivity and surface resistivity in the examples, comparative examples and FIGS. 6 to 12 was carried out by means of a resistometer (HR probe of Hirestor IP, produced by Mitsubishi Petrochemical Co., Ltd.). In some detail, the current value developed after 30 seconds of application of 100 V was read out.

EXAMPLE 2

As an electrically-conductive metal oxide there was used barium sulfate having an average grain diameter of 0.4 $\mu$m coated with a tin oxide-based electrically conducting agent (Pastran Type-IV) which had been surface-treated with $\gamma$-aminopropyltriethoxysilane. The electrically-conductive metal oxide was then added to the same polyimide varnish in an amount of 37 parts by weight based on 100 parts by weight of the resin component constituting the varnish. The mixture was then thoroughly stirred by means of a mixer.

The film-forming stock solution thus obtained was uniformly casted onto a stainless steel sheet to a thickness of 300 μm, dried in a 120° C. atmosphere for 120 minutes, and then stepwise heated to a temperature of 150° C. for 30 minutes, 200° C. for 30 minutes, 250° C. for 60 minutes, 350° C. for 30 minutes, and then 420° C. for 30 minutes to obtain a 80 μm thick polyimide sheet.

The polyimide sheet thus obtained was then slit into a strip having a length of 540 mm and a width of 320 mm. The strip thus obtained was then coated with a heat-resistant adhesive comprising a silane-modified polyimide resin (UPA-8322, produced by Ube Industries, Ltd.) at one end thereof over a width of 10 mm. The both ends of the strip were then superimposed on each other so that they were bonded to each other.

Thereafter, a surface layer was formed on the strip in the same manner as in Example 1. The two-layer intermediate transfer belt thus prepared exhibited a surface resistivity of $10^{12.0}\Omega/\square$ and a volume resistivity of $10^{10.5}\Omega$cm.

EXAMPLE 3

A fluororubber coating of FEP having carbon black dispersed therein (DAI-EL Latex NF-915) was applied to the same substrate 7*a* as used in Example 1 by spray coating method, and then heated to a temperature of 300° C. for 30 minutes to form a 50 μm thick coating layer having carbon black dispersed therein. This coating layer consisted of a 2 μm thick surface layer 7*d* obtained by hardening of FEP resin and a 48 μm thick fluororubber interlayer 7*c*. The surface layer 7*d* exhibited a volume resistivity of $10^{12.0}\Omega$cm and a contact angle θ of 100° with respect to water droplet. The intermediate transfer belt 7 exhibited a surface resistivity of $10^{11.9}\Omega/\square$ and a volume resistivity of $10^{12.0}\Omega$cm.

EXAMPLE 4

A 50 μm thick seamless belt substrate made of a polyimide having an electrically-conductive metal oxide dispersed therein was prepared in the same manner as in Example 2 except that the film-forming stock solution was casted to a thickness of 200 μm. Thereafter, a surface layer was formed on the belt substrate in the same manner as in Example 3. The three-layer intermediate transfer belt thus prepared exhibited a surface resistivity of $10^{11.9}\Omega/\square$ and a volume resistivity of $10^{11.8}\Omega$cm.

EXAMPLE 5

A three-layer intermediate transfer belt comprising an incompatible rubber layer 7*c* having two kinds of carbon blacks dispersed therein and an urethane rubber-modified TFE resin layer 7*d* having carbon black dispersed therein provided on a carbon black-modified polyimide film 7*a* was prepared in the following manner.

To 100 parts by weight of a rubber material (NE40, produced by Japan Synthetic Rubber Co., Ltd.) having a 4:6 (by weight) blend of NBR and EPDM were added 7 parts by weight of acetylene black (particulate acetylene black mentioned above) and 20 parts by weight of thermal black (Asahi Thermal FT mentioned above). The mixture was then kneaded. The difference in SP value between NBR (SP value: 9.3) and EPDM (SP value: 8.0) is 1.3.

The material thus kneaded was then processed into a sheet. The sheet thus obtained was then contact-bonded to the same carbon black-dispersed polyimide film substrate as used in Example 1. The sheet-like material was then heated to a temperature of 150° C. under a pressure of 5.5 kg/cm$^3$ in a vulcanizer for 60 minutes so that the blending rubber material was vulcanized. Thus, a polyimide film coated with a 40 μm thick incompatible rubber material having two kinds of carbon blacks dispersed therein as an interlayer was obtained.

Subsequently, the same aqueous emulsion coating as used in Example 1 was applied to the foregoing interlayer by spray coating method, and then heated to a temperature of 150° C. for 10 minutes to form a 10 μm thick surface layer. The surface layer 7*d* exhibited a volume resistivity of $10^{11.2}\Omega$cm and a contact angle θ of 90° with respect to water droplet. The intermediate transfer belt made of the foregoing belt material exhibited a surface resistivity of $10^{12.0}\Omega/\square$ and a volume resistivity of $10^{11.2}\Omega$cm.

EXAMPLE 6

A three-layer intermediate transfer belt comprising a carbon black-dispersed polyimide film 7*a,* an adhesive layer 7*c* and a carbon black-dispersed ETFE resin layer 7*d* was prepared in the following manner.

Carbon black was added to an ETFE resin in an amount of 9 parts by weight based on 100 parts by weight of the resin to give an ETFE resin having a volume resistivity of $10^{11.5}\Omega$cm and a contact angle θ of 100° with respect to water droplet as a surface layer. The carbon black-dispersed ETFE resin thus obtained was then formed into a 100 μm thick sheet. The resin sheet was then subjected to corona discharge treatment on the surface thereof at an intensity of 150 W.min/m$^2$ by means of a corona discharger (Corona Treater P1000, produced by Tomoe Engineering Co., Ltd.) to enhance the adhesivity thereof.

Subsequently, the foregoing resin sheet and the same carbon black-dispersed polyimide film as used in Example 1 were heated to a temperature of 150° C. for 120 minutes while the polyimide film was being pressed against the discharged surface of the resin sheet with a sheet-like hot-melt type special modified adhesive (Staystick 473) mixed with an epoxy resin mainly composed of silicone provide interposed therebetween so that the film and the resin sheet were bonded to each other. The adhesive layer had a thickness of 20 μm. The intermediate transfer belt thus prepared exhibited a surface resistivity of $10^{12.5}\Omega/\square$ and a volume resistivity of $10^{11.5}\Omega$cm.

COMPARATIVE EXAMPLE 1

A seamless belt made of a carbon black-dispersed polyimide having a surface resistivity of $10^{11.5}\Omega/\square$ and a volume resistivity of $10^{8.9}\Omega$cm was prepared in the same manner as in Example 1.

COMPARATIVE EXAMPLE 2

A seamless belt made of a polyimide having an electrically-conductive metal oxide dispersed therein having a surface resistivity of $10^{12.5}\Omega/\square$ and a volume resistivity of $10^{7.3}\Omega$cm was prepared in the same manner as in Example 1.

COMPARATIVE EXAMPLE 3

A 150 μm thick seamless belt made of a thermoplastic PC (polycarbonate) having carbon black dispersed therein was prepared by extrusion method. The PC resin belt thus prepared exhibited a surface resistivity of $10^{11.9}\Omega/\square$ and a volume resistivity of $10^{12.5}\Omega$cm.

COMPARATIVE EXAMPLE 4

A 150 μm thick seamless belt made of a thermoplastic ETFE having carbon black dispersed therein was prepared by extrusion method. The ETFE resin belt thus prepared exhibited a surface resistivity of $10^{11.5}\Omega/\square$ and a volume resistivity of $10^{9.0}\Omega$cm.

The layer structure, surface resistivity and volume resistivity of these intermediate transfer belt materials are all set forth in Table 1 below.

TABLE 1

| | Substrate | Interlayer | Surface layer | Surface resistivity (log Ω/□) | Volume resistivity (log Ω cm) |
|---|---|---|---|---|---|
| Example 1 | Polyimide CB | | Rubber-modified resin, CD | 12.1 | 11.0 |
| Example 2 | Polyimide Metal oxide | | Rubber-modified resin, CB | 12.0 | 10.5 |
| Example 3 | Polyimide CD | Fluororubber CB | FEP Cn | 11.9 | 12.0 |
| Example 4 | Polyimide Metal oxide | Fluororubber CB | FEP CB | 11.9 | 11.8 |
| Example 5 | Polyimide CB | Incompatible rubber Two kinds of CB | Rubber-modified resin, CB | 12.0 | 11.2 |
| Example 6 | Polyimide CB | Adhesive | ETPE CB | 12.5 | 11.5 |
| Comparative Example 1 | Polyimide CB | | | 11.8 | 8.9 |
| Comparative Example 2 | Polyimide Metal oxide | | | 12.5 | 7.3 |
| Comparative Example 3 | Polycarbonate CB | | | 11.9 | 12.5 |
| Comparative Example 4 | RTFB CB | | | 11.5 | 9.0 |

CB: Carbon black
Rubber-modified resin: Urethane-modified fluororesin (Test on mechanical properties of intermediate transfer belt material)

The substrates of the intermediate transfer belt materials prepared in Examples 1 to 6 and the intermediate transfer belt materials prepared in Comparative Examples 1 to 4 were measured for tensile strength and Young's modulus (tensile modulus) in accordance with JIS K 7127.

In some detail, for the measurement of tensile strength, a 5×40 mm strip was used. The measurement was carried out at a pulling rate of 200 mm/min. For the measurement of Young's modulus, a 25×250 mm strip was used. The measurement was carried out at a pulling rate of 20 mm/min.

(Test on evaluation of image quality)

The intermediate transfer belts of the foregoing examples and comparative examples were each mounted in the image forming apparatus shown in FIG. 5 and then subjected to copy test. The images thus obtained were then visually evaluated for quality in accordance with the following criteria. These measurements and evaluation results are set forth in Table 2 below together with the volume resistivity and contact angle θ of the surface layer.

Evaluation of hollow character:

E. No hollow characters occur;

G: Slight hollow characters occur;

P: Hollow characters occur

Evaluation of blue:

G: No blur occurs;

P: Blur occurs

TABLE 2

| | Tensile strength (kg/cm²) | Young's modulus (kg/cm²) | Volume resistivity (logΩcm) | Contact angle (θ) | Evaluation of image quality: Hollow character | Evaluation of image quality: Blue |
|---|---|---|---|---|---|---|
| Example 1 | 2,500 | 62,000 | 11.2 | 90 | E | G |
| Example 2 | 2,500 | 62,000 | 11.2 | 90 | E | G |
| Example 3 | 2,500 | 62,000 | 12.0 | 100 | E | G |
| Example 4 | 2,500 | 62,000 | 12.0 | 100 | E | G |
| Example 5 | 2,500 | 62,000 | 11.2 | 90 | E | G |
| Example 6 | 2,500 | 62,000 | 11.5 | 100 | E | G |
| Comparative Example 1 | 2,500 | 62,000 | See Table 1 | 70 | P | P |

TABLE 2-continued

| | Tensile strength | Young's modulus | Volume resistivity | Contact | Evaluation of image quality | |
|---|---|---|---|---|---|---|
| | (kg/cm$^2$) | (kg/cm$^2$) | (logΩcm) | angle (θ) | Hollow character | Blue |
| Comparative Example 2 | 2,500 | 62,000 | " | 12 | P | P |
| Comparative Example 3 | 660 | 24,000 | " | 15 | P | G |
| Comparative Example 4 | 430 | 12,000 | " | 100 | G | P |

Despite of the substrate's great Young's modulus, the intermediate transfer belts of the various examples shown in Table 2 are not liable to occurrence of hollow character because they comprise an elastic interlayer or an elastic surface layer having a surface energy as small as not less than 90° as represented by contact angle θ and a relatively small Young's modulus. Further, these intermediate transfer belts are not liable to occurrence of blue because they exhibit a surface resistivity falling within a proper range and comprise a surface layer having a volume resistivity falling within a proper range.

On the other hand, the single-layer intermediate transfer belts of Comparative Examples 1 and 2 comprising a substrate according to the present invention are liable to occurrence of hollow character although they exhibit a Young's modulus as great as 62,000 kg/cm$^2$ and thus deform little when stressed during driving. At the same time, since these intermediate transfer belts exhibit a small surface energy, the toner on these intermediate transfer belts can hardly be transferred to the paper. Further, these intermediate transfer belts exhibit a volume resistivity falling below the proper range and thus are liable to occurrence of blur.

The intermediate transfer belt of Comparative Example 3 comprising as a belt material a PC resin having a surface energy as great as 75° as represented by contact angle θ is liable to occurrence of hollow character because the toner thereon can hardly be transferred to the paper. The intermediate transfer belt of Comparative Example 4 comprising as a belt material an ETFE resin having a surface energy as small as 100° as represented by contact angle θ shows a slight level of hollow character but shows some blur because it exhibits a volume resistivity falling below the proper range. Further, the intermediate transfer belts of Comparative Examples 3 and 4 exhibit a Young's modulus as small as 24,000 kg/cm$^2$ and 12,000 kg/cm$^2$, respectively, and thus deform greatly when stressed during driving, causing shear in color printing.

(Volume resistivity of carbon black-dispersed urethane rubber-modified TFE resin)

Figure 6:
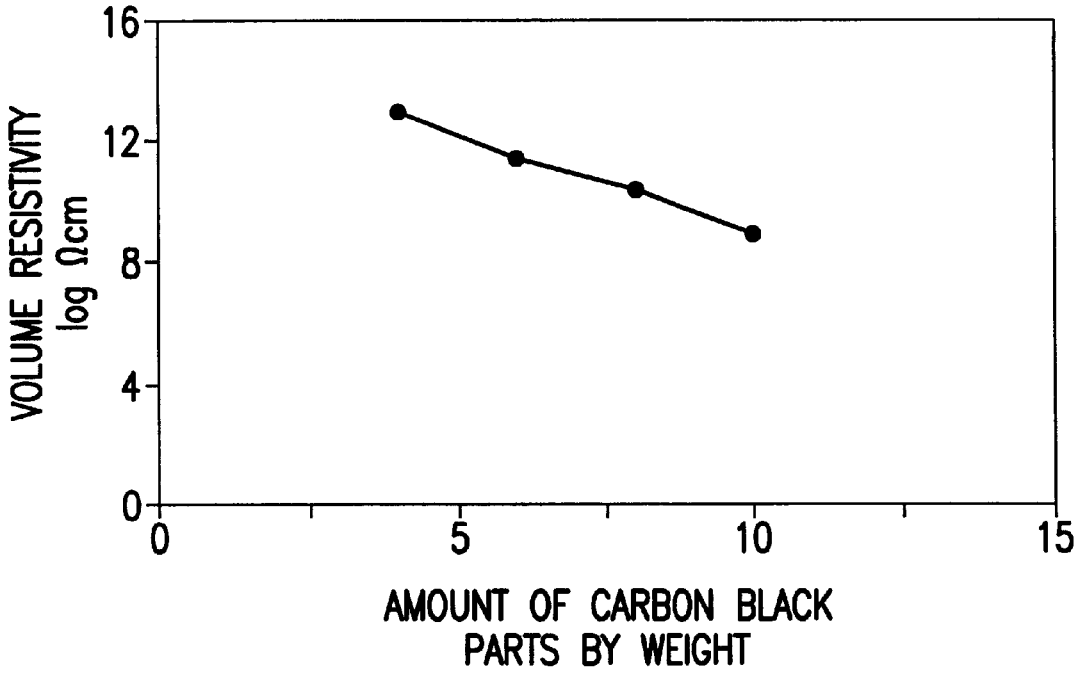
FIG. 6 is a graph illustrating the relationship between the blended amount of carbon black and the volume resistivity of a urethane rubber-modified fluororesin having carbon black dispersed therein.

FIG. 6 graphically illustrates the relationship between the amount of carbon black to be incorporated in the aqueous emulsion coating (Emralon JYL-601ESD) used in Examples 1, 2, and 5 based on 100 parts by weight of urethane rubber-modified TFE resin and the volume resistivity of the surface layer-forming material.

As shown in FIG. 6, the volume resistivity of the surface layer falling within the range of from $10^{10}$ to $10^{13}$ can be obtained by incorporating carbon black in an amount of from about 4 to 9 parts by weight based on 100 parts by weight of the urethane rubber-modified TFE resin.

(Volume resistivity of carbon black-dispersed fluorinic high molecular weight material)

Figure 7:
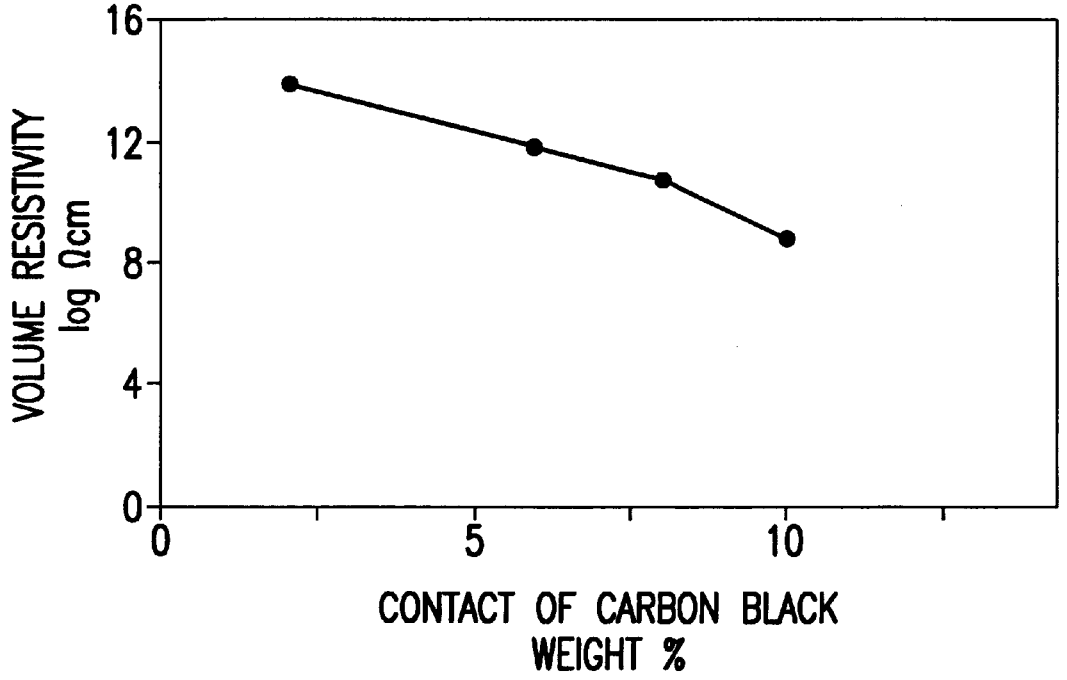
FIG. 7 is a graph illustrating the relationship between the blended amount of carbon black and the volume resistivity of a fluorinic high molecular weight material having carbon black dispersed therein.

FIG. 7 graphically illustrates the relationship between the amount (% by weight) of carbon black to be incorporated as solid content in the FEP-containing fluororubber coating (DAI-EL Latex NF-915) used in Examples 3 and 4 and the volume resistivity of the coating layer-forming material.

As shown in FIG. 7, the volume resistivity of the surface layer falling within the range of from $10^{10}$ to $10^{13}$ can be obtained by incorporating carbon black in an amount of from about 4 to 9% by weight based on the fluororubber coating.

(Volume resistivity of carbon black-dispersed blending rubber material)

Figure 8:
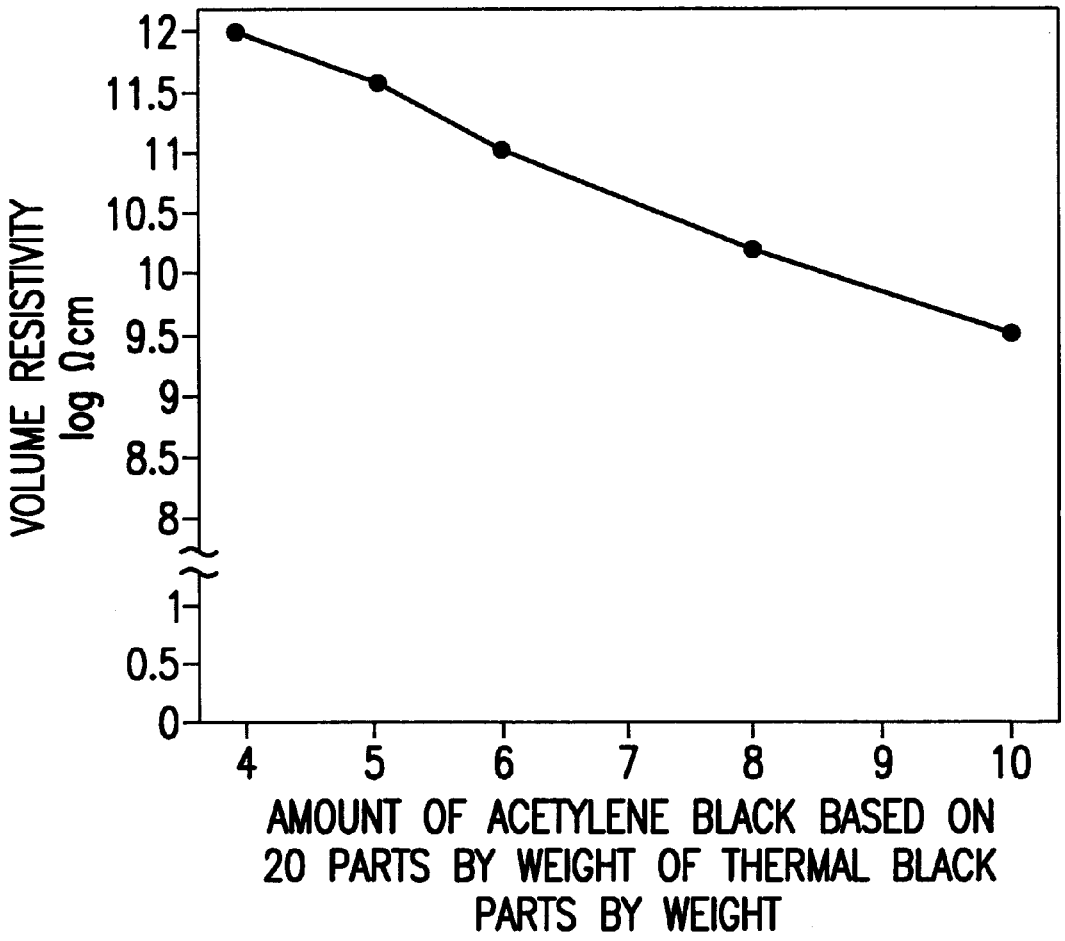
FIG. 8 is a graph illustrating the relationship between the amount of acetylene black to be used in combination with thermal black and the volume resistivity of an incompatible blend rubber material having the two carbon blacks dispersed therein.

FIG. 8 graphically illustrates the relationship between the amount (4 to 10 parts by weight) of acetylene black to be incorporated based on 100 parts by weight of the incompatible blending rubber material (NE40) in combination with 20 parts by weight of a thermal black having a DBP oil absorption different from that of the acetylene black and the volume resistivity of the carbon black-dispersed blending rubber material in the interlayer of Example 5.

As shown in FIG. 8, if a thermal black is used as well, the incompatible blending rubber material shows little volume resistivity change with the change of the content of acetylene black. Accordingly, the preparation of an interlayer from such a material makes it possible to obtain an intermediate transfer belt having a stabilized volume resistivity.

Figure 9:
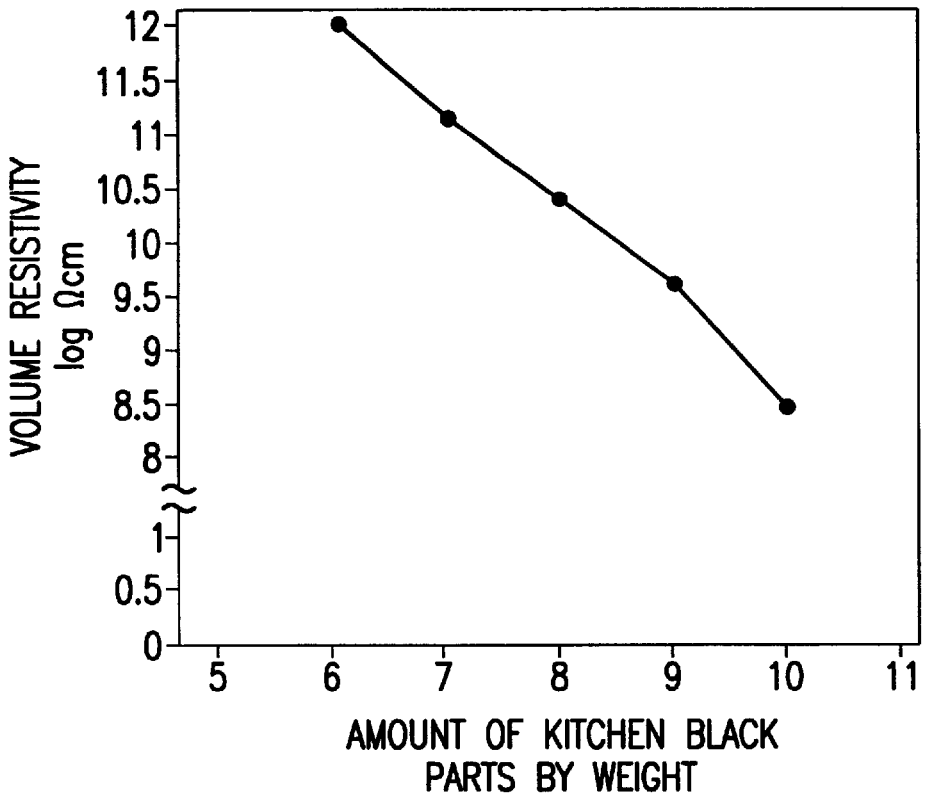
FIG. 9 is a graph illustrating the relationship between the amount of a carbon black to be incorporated in an incompatible blend rubber material and the volume resistivity of the blend rubber material having carbon black dispersed therein.

As a reference example, the relationship between the amount of carbon black to be incorporated based on 100 parts by weight of the foregoing blending rubber material and the volume resistivity of the carbon black-dispersed blending rubber material is shown in FIG. 9. As carbon black there was used the kitchen black previously mentioned.

If a kitchen black having a high DBP oil absorption is incorporated in the foregoing rubber material, the rubber material shows a great resistivity change with the change of the amount of the kitchen black. Accordingly, if it is desired to form an elastic interlayer, two or more kinds of carbon blacks having different DBP oil absorption values are preferably used in combination with the kitchen black.

(Volume resistivity of carbon black-dispersed ETFE resin)

Figure 10:
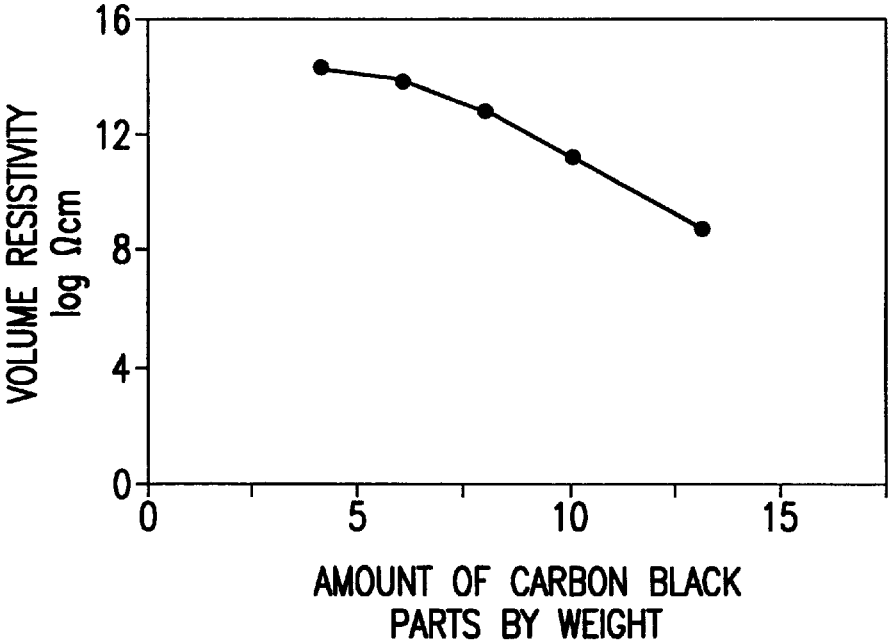
FIG. 10 is a graph illustrating the relationship between the blended amount of carbon black and the volume resistivity of ETFE resin having carbon black dispersed therein.

FIG. 10 graphically illustrates the relationship between the amount of carbon black to be incorporated based on 100 parts by weight of ETFE resin and the volume resistivity of the carbon black-dispersed ETFE resin in the surface layer of Example 6.

As shown in FIG. 10, the volume resistivity of the surface layer falling within the range of from $10^{10}$ to $10^{13}$ can be obtained by incorporating carbon black in an amount of from about 8 to 12% by weight based on 100 parts by weight of the ETFE resin.

(Relationship between the surface resistivity and the volume resistivity of polyimide resin material having an electrically conducting agent dispersed therein)

Figure 11:
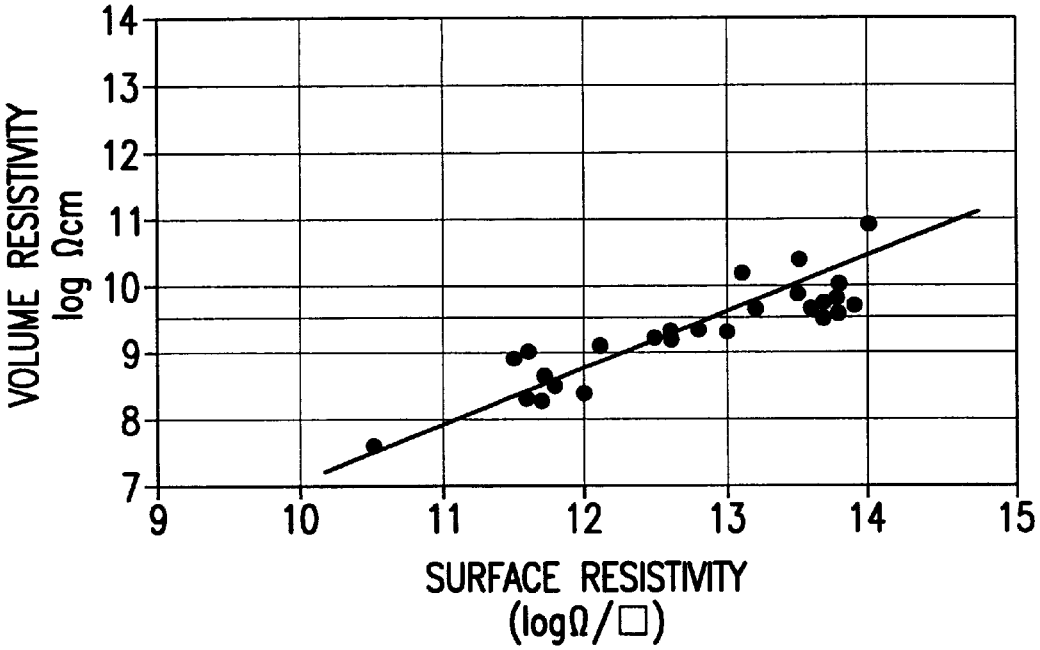
FIG. 11 is a graph illustrating the relationship between the surface resistivity and the volume resistivity of a polyimide resin material having carbon black dispersed therein.

FIG. 11 graphically illustrates the relationship between the surface resistivity and the volume resistivity of a polyimide resin film developed when the amount of carbon black to be dispersed in the polyimide resin changes. The foregoing resin film was prepared in the same manner as in Example 1.

Figure 12:
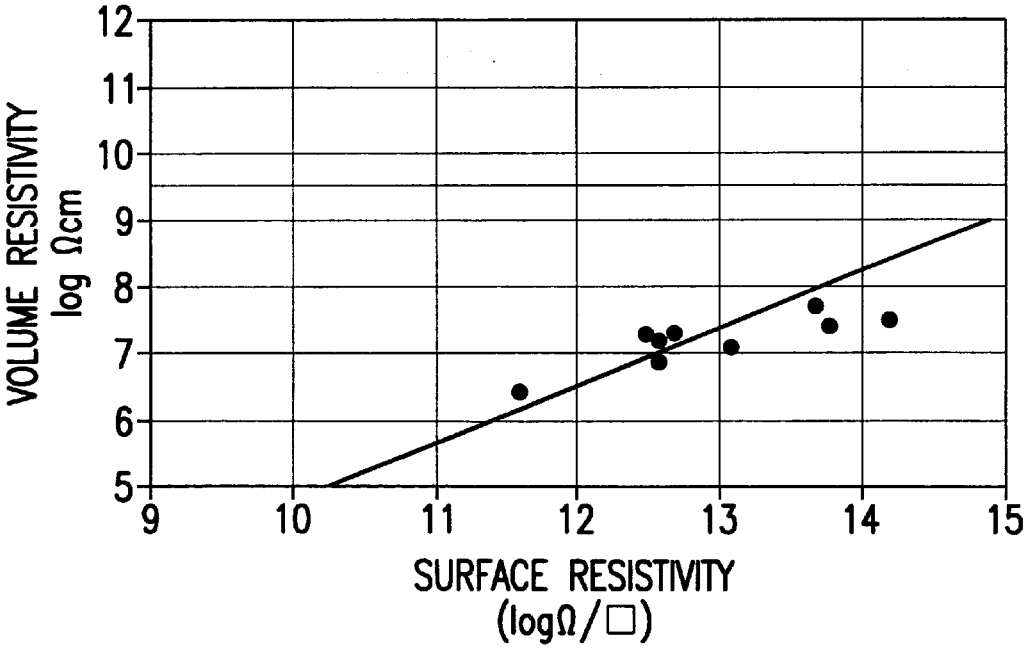
FIG. 12 is a graph illustrating the relationship between the surface resistivity and the volume resistivity of a polyimide resin material having an electrically-conductive metal oxide dispersed therein, wherein the symbol U indicates an image forming apparatus, the symbol P indicates a paper (recording medium), the reference numeral 1 indicates an image carrier, the reference numeral 4 indicates a developing apparatus, the reference numeral 7 indicates an intermediate transfer belt, the reference numeral 7*a* indicates a substrate, the reference numerals 7*b*, 7*d* each indicate a surface layer, the reference numeral 7*c* indicates an interlayer, and the reference numeral 10 indicates a bias roll.

FIG. 12 graphically illustrates the relationship between the surface resistivity and the volume resistivity of a polyimide resin sheet developed when the amount of an electrically-conductive metal oxide surface-treated with the foregoing silane-based coupling agent to be dispersed in the polyimide resin changes. The foregoing resin sheet was prepared in the same manner as in Example 2.

The intermediate transfer belt according to the present invention comprises a substrate having a great Young's modulus and thus deforms little when stressed during driving. Thus, the intermediate transfer belt according to the present invention can invariably provide a high quality transfer image. Further, the intermediate transfer belt according to the present invention comprises a surface layer having a volume resistivity falling within a proper range and thus is not liable to occurrence of blur during transfer. This arrangement requires no destaticizing mechanism.

If the surface layer of the intermediate transfer belt is made of a nonadhesive material having a small surface energy, it is not likely that maltransfer can occur, that is, toner image on the intermediate transfer belt cannot be secondarily transferred to the recording medium. Further, the occurrence of hollow character can be inhibited. Moreover, if the interlayer or surface layer is made of an elastic material, or the Young's modulus of the surface layer is relatively small, the resulting intermediate transfer belt deforms following the pressure of the bias roll, making it possible to inhibit the occurrence of image defects due to hollow character.

On the other hand, the process for the preparation of an intermediate transfer belt according to the present invention makes it possible to form an interlayer and a surface layer from a fluorinic high molecular weight material having carbon black dispersed therein at a step.

While the invention has been described in detail and with reference to specific embodiments thereof, it will be apparent to one skilled in the art that various changes and modifications can be made therein without departing from the spirit and scope thereof.

What is claimed is:

1. An image forming apparatus comprising:

an image carrier for forming an electrostatic latent image thereon corresponding to image formation;

a developing apparatus for developing the electrostatic latent image formed on said image carrier with a toner to render it visible as a toner image;

an intermediate transfer belt onto which the toner image carried on said image carrier is primarily transferred to form an unfixed toner image on the intermediate transfer belt; and a bias roll for secondarily transferring the unfixed toner image from said intermediate transfer belt to a recording medium, wherein said intermediate transfer belt has a layer structure comprising a plurality of belt materials including at least a substrate and a surface layer, said substrate is made of a resin material comprising an electrically-conducting material disposed therein and exhibits a Young's modulus of not less than 35,000 $kg/cm^2$ and said surface layer exhibits a volume resistivity of from $10^{10}$ Ωcm to $10^{13}$ Ωcm.

2. The image forming apparatus according to claim 1, wherein said surface layer is made of a material comprising an electrically-conducting material dispersed therein having a contact angle of not less than 90° with respect to water droplet as represented by wettability by water.

3. The image forming apparatus according to claim 2, wherein said material is made of a fluorinic high molecular weight material.

4. The image forming apparatus according to claim 1, wherein said intermediate transfer belt is made of a two-layer belt material including said substrate and a surface layer comprising a rubber-modified fluororesin material comprising an electrically-conducting material dispersed therein.

5. The image forming apparatus according to claim 4, wherein said rubber-modified fluororesin material is a urethane rubber-modified fluororesin material comprising carbon black dispersed therein.

6. The image forming apparatus according to claim 4, wherein said substrate has a thickness of not less than 50 μm and said surface layer has a thickness of not less than three times an average grain diameter of the toner.

7. The image forming apparatus according to claim 4, wherein said substrate is made of a polyimide resin material comprising carbon black dispersed therein.

8. The image forming apparatus according to claim 4, wherein said substrate is made of a polyimide resin material comprising an electrically-conductive metal oxide dispersed therein.

9. The image forming apparatus according to claim 1, wherein said intermediate transfer belt is made of a three-layer belt material including said substrate, an interlayer composed of an elastic material having an electrically-conducting material dispersed therein and a surface layer composed of a fluorinic high molecular weight material having an electrically-conducting material dispersed therein.

10. The image forming apparatus according to claim 9, wherein said substrate has a thickness of not less than 50 μm, said interlayer has a thickness of not less than three times an average grain diameter of the toner, and said surface layer has a thickness of not more than 5 μm.

11. The image forming apparatus according to claim 1, wherein said intermediate transfer belt is made of a three-layer belt material including said substrate, an interlayer comprising an elastic material and a surface layer composed of a rubber-modified fluororesin material comprising an electrically-conducting material dispersed therein.

12. The image forming apparatus according to claim 11, wherein said surface layer is made of a urethane rubber-modified fluororesin material comprising carbon black dispersed therein, said substrate has a thickness of not less than 50 μm, said interlayer has a thickness of not less than three times an average grain diameter of the toner, and said surface layer has a thickness of not more than 5 μm.

13. The image forming apparatus according to claim 11, wherein said interlayer is made of an incompatible blend rubber material comprising carbon black dispersed therein.

14. The image forming apparatus according to claim 13, wherein said blend rubber material is made of at least two rubber materials which differ in solubility parameter by not less than 1.0.

15. The image forming apparatus according to claim 14, wherein said blend rubber material is made of a mixture comprising NBR and EPDM.

16. The image forming apparatus according to claim 13, wherein as said carbon black there are used two or more carbon blacks having different properties.

17. The image forming apparatus according to claim 16, wherein said carbon blacks have different DBP oil absorption values.

18. The image forming apparatus according to claim 17, wherein as said carbon black there is used a mixture of acetylene black having a high DBP oil absorption value and thermal black having a low DBP oil absorption value.

19. The image forming apparatus according to claim 2, wherein said intermediate transfer belt is made of a three-layer belt material including said substrate, an interlayer composed of an adhesive and a surface layer having a Young's modulus of not more than 15,000 kg/cm$^2$.

20. The image forming apparatus according to claim 19, wherein said interlayer is made of an adhesive having an elasticity and said surface layer is made of a fluororesin material comprising carbon black dispersed therein.

21. The image forming apparatus according to claim 20, wherein said adhesive is a sheet-like silicone-modified epoxy resin-based adhesive and said fluororesin material is an ethylene-tetrafluoroethylene copolymer resin.

22. The image forming apparatus according to claim 9, wherein said substrate is made of a polyimide resin material comprising carbon black dispersed therein.

23. The image forming apparatus according to claim 9, wherein said substrate is made of a polyimide resin material comprising an electrically-conductive metal oxide dispersed therein.

* * * * *